United States Patent [19]

Kross et al.

[11] 3,940,019

[45] Feb. 24, 1976

[54] AUTOMATIC MIXED DRINK DISPENSING APPARATUS

[75] Inventors: Robert W. Kross, Dallas; Larry D. Fiel, Argyle; Charles R. Crockett; George B. Neely, both of Richardson; Louis J. Benton, Plano, all of Tex.

[73] Assignee: Leisure Products Corporation, Plano, Tex.

[22] Filed: Sept. 30, 1974

[21] Appl. No.: 510,655

[52] U.S. Cl. ..... 222/30; 222/66; 222/70; 222/76; 222/108; 222/129.2; 222/129.4; 222/153; 222/333

[51] Int. Cl.[2] ..... B67D 5/56

[58] Field of Search..... 222/129.4, 129.1, 129.3, 222/129.2, 70, 76, 66, 30, 333, 334, 255, 153, 139, 108

[56] References Cited

UNITED STATES PATENTS

| | | | |
|---|---|---|---|
| 1,772,111 | 8/1930 | Rice | 222/129.1 |
| 2,755,979 | 7/1956 | Lawson et al. | 222/129.4 |
| 3,089,618 | 5/1963 | Forsyth | 222/66 |
| 3,142,267 | 7/1964 | Shofer | 222/129.2 |
| 3,331,536 | 7/1967 | Lorenzo | 222/129.1 X |
| 3,401,639 | 9/1968 | Schwertfager et al. | 222/129.4 X |
| 3,409,175 | 11/1968 | Byrne | 222/129.4 X |
| 3,428,218 | 2/1969 | Coja | 222/129.4 |

*Primary Examiner*—Stanley H. Tollberg
*Assistant Examiner*—Hadd S. Lane
*Attorney, Agent, or Firm*—Richards, Harris and Medlock

[57] ABSTRACT

An automatic mixed drink dispensing apparatus includes a housing including a secured liquor receiving zone which receives a plurality of liquor containers. The housing also receives syrup containers, a water container, and a carbon dioxide container. An ice chest is mounted in the upper portion of the housing and has a liquid chilling apparatus in the bottom thereof. A dispensing head is mounted on the housing and extends into a mixed drink preparation zone. Drains extend from a point in the mixed drink preparation zone beneath the dispensing head and from a point in the bottom of the ice chest to a drain pan slidably supported in the bottom of the housing. Liquor pumps function to withdraw liquor from the liquor containers and to discharge the liquor through the dispensing head. The syrup containers are pressurized with carbon dioxide from the carbon dioxide container, whereby syrup is caused to flow through the liquid chilling apparatus and through the dispensing head. A water pump withdraws water from the water container and directs the water through the liquid chilling apparatus and through the dispensing head. The water pump also directs water into a carbonating apparatus which supplies carbonated water. The flow of the various liquids through the dispensing head is regulated by solenoid-actuated valves which are in turn controlled by electronic circuitry. The electronic circuitry responds to actuation of push-buttons individual to particular mixed drinks to select the liquids necessary in formulating a desired mixed drink and to actuate the valves to effect discharge of the proper amount of each liquid through the dispensing head.

39 Claims, 24 Drawing Figures

AUTOMATIC MIXED DRINK DISPENSING APPARATUS

BACKGROUND AND SUMMARY OF THE INVENTION

This invention relates to an automatic mixed drink dispensing apparatus, and more particularly to a push-button controlled system for automatically preparing substantially all of the mixed drinks which are typically ordered by customers.

It is now well established that the manual preparation of mixed drinks inherently involves a number of substantial problems. For example, at a large cocktail party or reception, a number of bar locations and an equal or greater number of bartenders are required in order to provide mixed drinks for the guests. Notwithstanding the large inventory and labor costs which are involved in such an operation, there often are long lines at each bar location, leading to irritation of the guests and disruption of the affair. This is true because the manual preparation of a mixed drink involves a number of time consuming steps, such as selection of the proper liquor, pouring of the liquor, selection of one or more mixes, pouring of the mixes, etc.

Another problem involved in the manual preparation of mixed drinks is that of accountability. Depending on the particular bartender that is preparing the mixed drinks and other factors, the amount of liquor that is actually used in preparing each drink may vary to a considerable extent. When this factor is combined with such factors as spillage, breakage and thievery, the task of properly accounting for the liquor used in a manual mixed drink preparation operation becomes very substantial.

The foregoing problems have been at least partially recognized heretofore. For example, U.S. application Ser. No. 322,120, filed Jan. 8, 1973, now U.S. Pat. No. 3,814,285, granted to Bryant F. Craig on June 4, 1924 for BEVERAGE DISPENSING APPARATUS discloses an apparatus for dispensing mixed drinks which operates under the control of punched cards. However, experience with prior art devices has revealed a number of difficulties, particularly with respect to adaptation of such devices to a commercial mixed drink preparation operation. For example, the selection and use of a punched card for each drink to be dispensed is too time consuming to be practical in a commercial device. Additionally, prior art devices generally do not provide for accountability of liquors used. The ability to maintain accurate records with respect to liquor usage is considered to be highly advantageous in a commercially successful mixed drink preparation apparatus. Thus, a need exists for still further improvements in the art of automatic mixed drink preparation, particularly with respect to apparatus intended for commercial usage.

The present invention comprises an automatic mixed drink dispensing apparatus which overcomes the foregoing and other disadvantages long since associated with the prior art. In accordance with the broader aspects of the invention, a housing receives a plurality of quantities of liquors, each in its original container, a plurality of quantities of syrups, each in its original container, a quantity of water, and a quantity of carbon dioxide. The housing includes a top wall defining a mixed drink preparation zone, and a dispensing head is mounted on the housing and extends into the mixed drink preparation zone. An array of push-buttons is provided for actuation from the mixed drink preparation zone, with each push-button corresponding to a particular mixed drink. Upon actuation of a push-button, the various liquids necessary in the preparation of the drink are pumped from their various containers and are discharged through the dispensing head.

In accordance with more specific aspects of the invention, the housing further comprises a bottom wall, front and back walls, and opposed side walls. The front, back and side walls each comprise one or more openable panels to facilitate access to the entire interior of the housing. A bulkhead extends between the front, back, top, and bottom walls of the housing for cooperation with portions of the front and back walls and with one of the side walls to define a liquor receiving zone. The openable panels of the front and side walls which define the liquor receiving zone are adapted to be latched from within the housing, and the openable panel of the back wall which defines the liquor receiving zone is adapted to be locked, whereby the liquor receiving zone is secured against unauthorized entry.

An ice chest is mounted in the upper portion of the housing for access from the mixed drink preparation zone and has a liquid chilling apparatus mounted in the bottom thereof. A drain is mounted in the mixed drink preparation zone under the dispensing head. Drain conduits extend from the drain and from the bottom of the ice chest to a drain pan which is slidably supported in the bottom of the housing. The drain pan has a spigot which is selectively operable to allow fluid flow out of the drain pan.

Liquor is withdrawn from the liquor containers in the liquor receiving zone and is discharged through the dispensing head by a plurality of liquor pumps each individual to one of the liquors. In a preferred embodiment, gas-operated liquor pumps are employed, and solenoid-actuated valves are utilized to regulate the amount of liquor dispensed. In an alternative embodiment, motor-driven liquor pumps are used, and the time period of operation of each pump is regulated in order to control the amount of liquor dispensed.

The syrup containers are charged with pressurized carbon dioxide from the carbon dioxide container. The syrups are directed from the containers through the liquid chilling apparatus and through the dispensing head under the action of the pressurized carbon dioxide. Solenoid-actuated valves are utilized to regulate the amount of syrup dispensed.

Water is withdrawn from the water container by a motor-driven water pump. The water is directed through the liquid chilling apparatus and through the dispensing head, with the quantity of water dispensed being regulated by a solenoid-actuated valve. Water is also directed to a carbonating apparatus which also receives carbon dioxide from the container thereof and serves to form carbonated water. Carbonated water from the carbonating apparatus is directed through the liquid chilling apparatus and through the dispensing head, with the quantity of carbonated water discharged also being regulated by a solenoid-actuated valve.

The operation of the mixed drink preparation system is under the control of electronic circuitry. Upon actuation of a push-button, the circuitry first functions to select the various liquids which are necessary in formulating the desired mixed drink. The circuitry then operates through the solenoid-actuated valves to discharge the required amount of each liquid through the dispensing head. In the case of the liquors, counters are operated in parallel with the solenoid-actuated valves, thereby maintaining a highly accurate accounting of the liquor dispensed.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
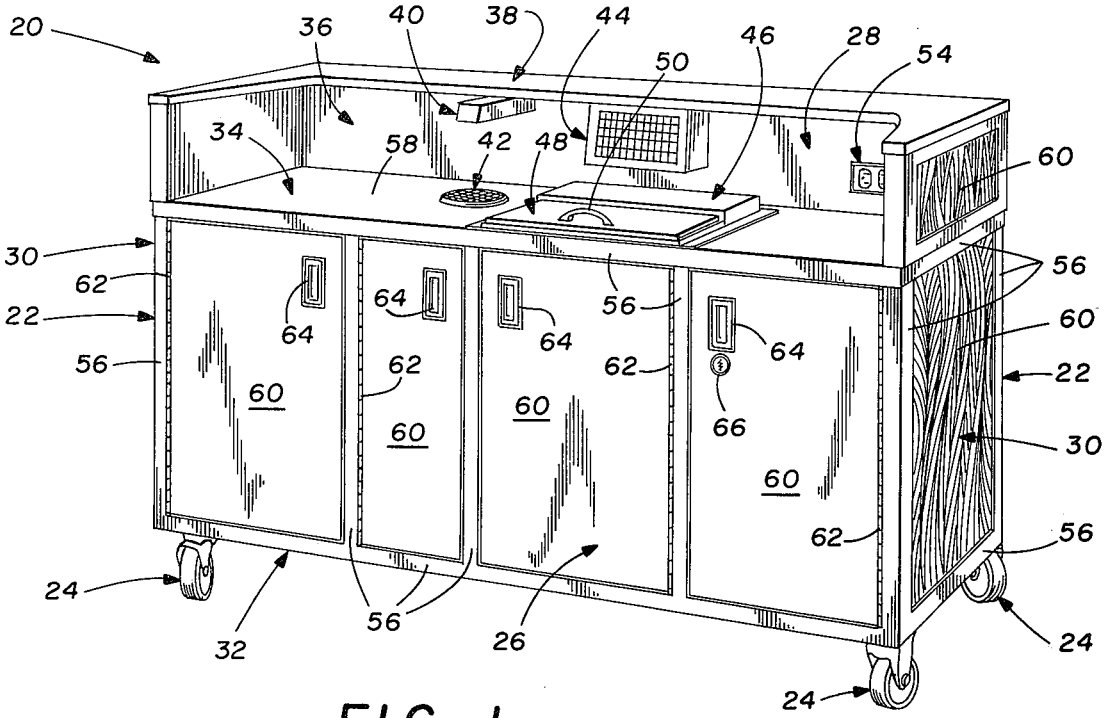
FIG. 1 is a perspective view of an automatic mixed drink dispensing apparatus incorporating the invention.
Figure 5:
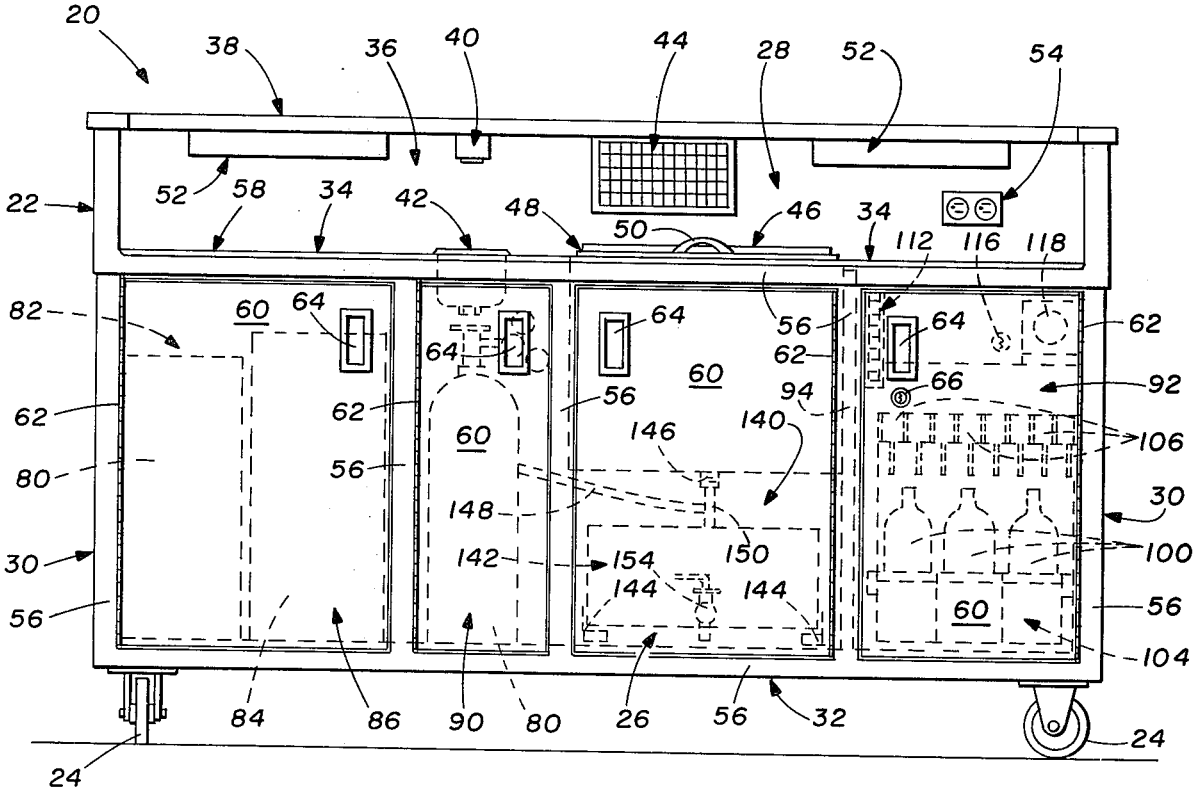
FIG. 5 is a front view of the automatic mixed drink dispensing apparatus illustrating certain features thereof.

Referring now to the drawings, and particularly to FIGS. 1 and 5 thereof, there is shown an automatic mixed drink dispensing apparatus 20 incorporating the present invention. The automatic mixed drink dispensing apparatus 20 includes a housing 22 which is supported on conventional casters 24 to facilitate portability of the automatic mixed drink dispensing apparatus 20. The housing 22 includes a back wall 26, a front wall 28, opposed side walls 30, a bottom wall 32 and a top wall 34. The front wall 28 and the side walls 30 extend upwardly beyond the top wall 34 for cooperation therewith to define a mixed drink preparation zone 36. A serving bar 38 extends around and partially over the mixed drink preparation zone 36.

A dispensing head 40 extends into the mixed drink preparation zone from the underside of the serving bar 38. A drain 42 is situated directly beneath the dispensing head 40. A push-button control panel 44 is mounted in the mixed drink preparation zone 36, as is the upper portion of a combined ice chest and cold plate apparatus 46, which may be of the type available through the Polar Chip Mfg. Co. of Fort Worth, Texas. Access to the interior of the latter apparatus from the mixed drink preparation zone 36 is provided through a slidably supported cover 48 having a handle 50. As is best shown in FIG. 5, the automatic mixed drink dispensing apparatus 20 further includes a pair of light fixtures 52 for illuminating the mixed drink preparation zone 36 and a convenience outlet 54 which supplies operating power for various appliances such as blenders, etc.

Referring again to FIG. 1, the housing 22 of the automatic mixed drink dispensing apparatus 20 comprises a plurality of framing members 56 formed from stainless steel, aluminum, or the like. The top wall 34 of the housing 22 defines a work surface 58 also formed from stainless steel, aluminum, or the like. Each of the back, front and side walls of the housing 22 defines at least one openable panel 60, whereby access is provided to the entire interior of the housing 22 for maintenance purposes, and the like.

For example, the openable panels 60 of the back wall 26 comprise doors formed from stainless steel, aluminum, or the like. Each of the doors comprising the panels 60 of the back wall 26 is pivotally secured to an adjacent framing member 56 by means of a piano hinge 62 and is provided with a handle 64. Moreover, the door of the back wall 26 at the extreme right-hand end thereof (FIG. 1) is provided with a key-operated lock 66.

Figure 4A:
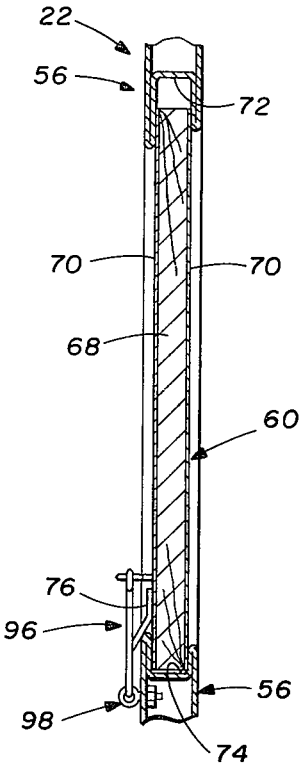
FIGS. 4*a*, 4*b*, and 4*c* comprise sequential illustrations showing the operation of certain panels comprising the housing of the automatic mixed drink dispensing apparatus.
Figure 4B:
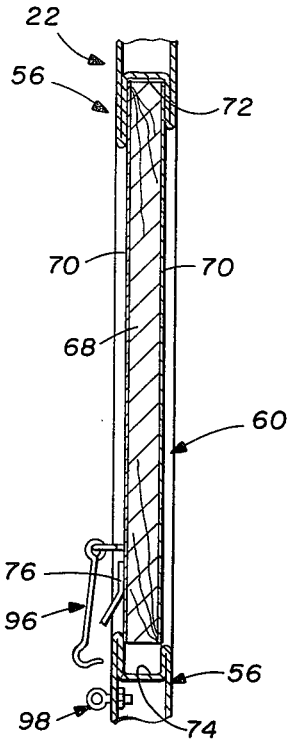
Figure 4C:
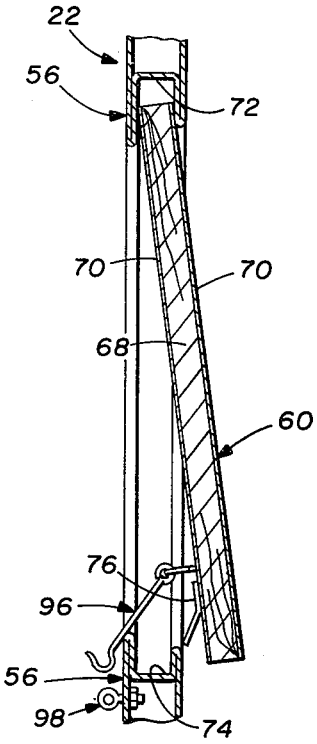

It will be understood that the doors comprising the openable panels 60 of the back wall 26 of the housing 22 are frequently opened during the operation of the automatic mixed drink dispensing apparatus 20. As opposed to these doors, the openable panels 60 comprising the front and side walls of the housing 22 normally remain in place, and are typically not removed except for maintenance purposes, or the like. As is best shown in FIGS. 4*a*, 4*b* and 4*c*, the panels 60 of the front and side walls each comprise a panel 68 formed from wood, plywood, metal, or the like, and having a decorative exterior layer 70 formed thereon, such as by means of painting, staining or coating the exterior of the panle 68, or by applying a covering thereto, or the like. For example, the panels 68 may be formed from plywood and may be provided with layers 70 comprising a suitable covering on one side and a stainless steel layer on the other side. Alternatively, the panels 68 may be formed from stainless steel and having a layer 70 comprising a suitable covering on one side thereof.

The framing members 56 which receive the openable panels 60 of the front and side walls define upper and lower channels 72 and 74. The channels 72 and 74 normally receive each of the panels 60 comprising the front and side walls in the manner illustrated in FIG. 4*a*. A particular panel 60 may be removed by raising the panel into the channel 72 as shown in FIG. 4*b*, and then pulling the panel outwardly in the manner illustrated in FIG. 4*c*. A removed panel or a replacement panel having, for example, a different type of exterior layer 70 may be positioned in the housing 22 by reversing the steps illustrated in FIGS. 4*a*, 4*b* and 4*c*. As the panel is lowered into the position illustrated in FIG. 4*a*, it is properly positioned vertically relative to the channels 72 and 74 by a clip 76 secured to the rear side of the panel 68.

Figure 2:
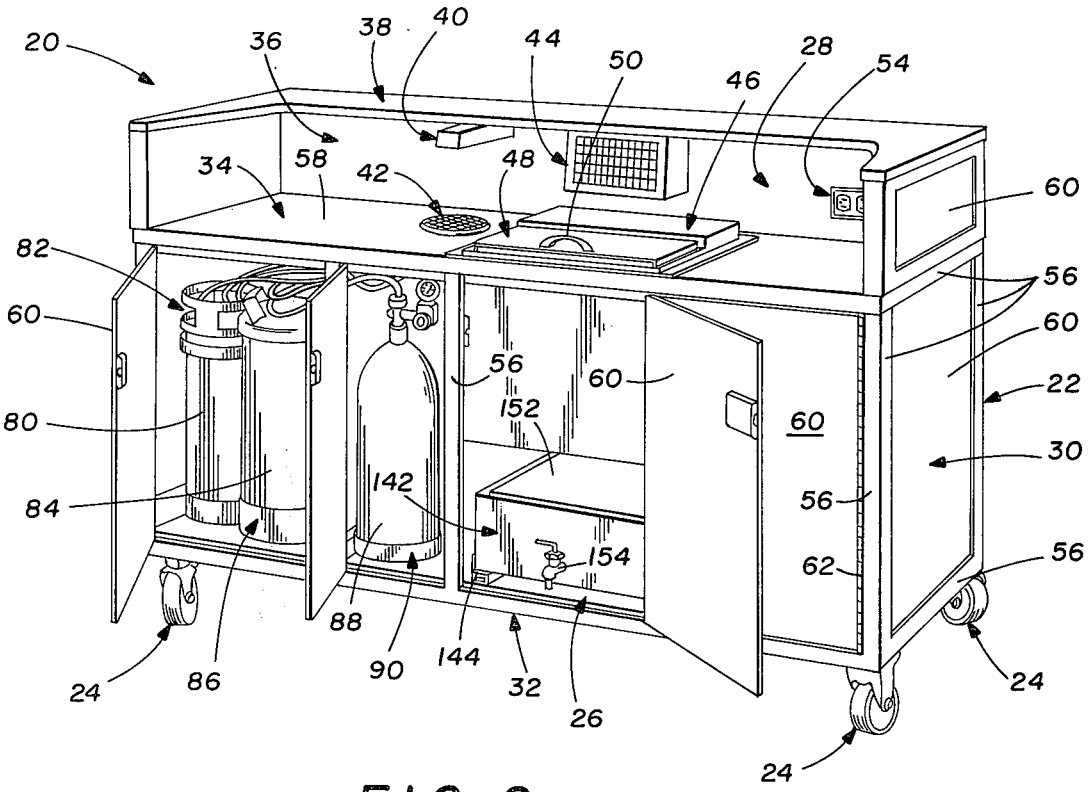
FIG. 2 is a view similar to FIG. 1 showing the automatic mixed drink dispensing apparatus with certain panels thereof opened.

Referring to FIGS. 2 and 5, the housing 22 of the automatic mixed drink dispensing apparatus 20 receives a plurality of syrup containers 80 in a syrup receiving zone 82. The containers 80 each have a plurality of syrup therein, and are of the type which are commercially obtainable from syrup supplying concerns. Thus, syrups are received and stored in their original containers. The housing 22 also receives a quantity of water in a container 84 defining a water receiving zone 86 and a quantity of compressed or pressurized carbon dioxide in a container 88 defining a carbon dioxide receiving zone 90.

The right-hand end (FIG. 5) of the housing 22 defines a liquor receiving zone 92. The liquor receiving zone 92 comprises a secured zone within the housing 22. To this end, the door comprising the portion of the back wall 26 which defines the liquor receiving zone 92 is provided with a key-actuated lock 66. Moreover, a bulkhead 94 extends between the bottom wall 32 and the top wall 34 and between the back wall 36 and the front wall 28 to prevent access to the interior of the liquor receiving zone 92 from within the housing 22.

The liquor receiving zone 92 is further defined by one of the removable panels 60 of one of the side walls 30 and by one of the removable panels 60 of the front wall 28. Referring to FIGS. 4*a*, 4*b* and 4*c*, each of the removable panels 60 of the front wall and the adjacent side wall which define portions of the liquor receiving zone 92 are provided with a hook-type latch 96. The latch 96 is receivable in an eye 98 secured to an adjacent portion of the frame 22 to prevent the panels 60 from being removed from the channels 72 and 74 in the manner illustrated in FIGS. 4*a*, 4*b*, and 4*c*. Access to the latches 96 is obtainable only from within the liquor receiving zone 92, and access to the interior of the liquor receiving zone 92 is possible only by way of the door of the back wall which is provided with the lock 66. It will thus be understood that the liquor receiving zone 92 comprises a completely secure zone within the housing 22 of the automatic mixed drink dispensing apparatus 20.

Figure 7:
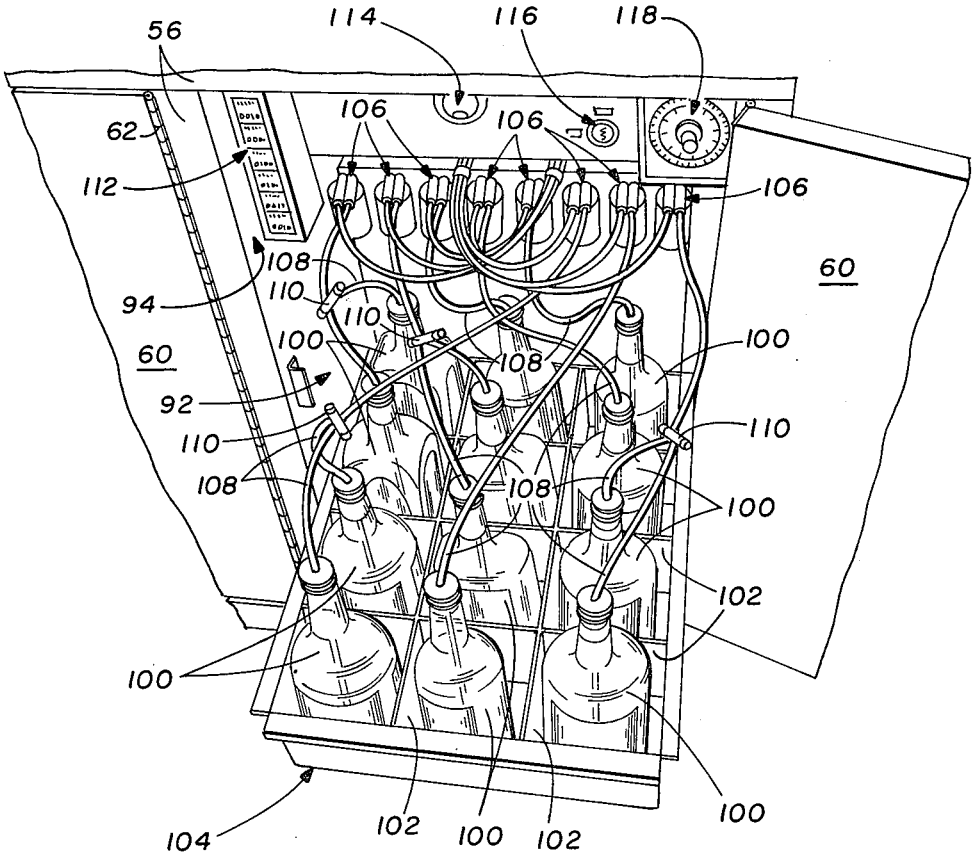
FIG. 7 is a perspective view illustrating the liquor receiving zone of the automatic mixed drink dispensing apparatus.

The interior of the liquor receiving zone 92 of the housing 22 is illustrated in FIG. 7. A plurality of liquor containers 100 are individually received in compartments defined by partitions 102 mounted in a slidably supported bin 104. An important feature of the present invention comprises the fact that the liquor containers 100 comprise the original liquor bottles in which the various liquors are received from the distributor thereof. Typically these are half-gallon liquor bottles, however, it will be understood that smaller or larger liquor bottles may be used in the practice of the invention, if desired. A plurality of liquor pumps 106 are mounted within the liquor receiving zone 92. The interior of each liquor container 100 is connected to one of the liquor pumps 106 through a conduit 108. In the practice of the invention, it is sometimes desirable to have two of the containers 100 receive an identical liquor. In such instances the conduits 108 extending from the containers 100 having identical liquors contained therein are joined by a three-way valve 110. This three-way valve may be a solenoid-actuated valve mounted with the pumps in the back frame of the housing 22.

The liquor receiving zone 92 further comprises a plurality of counters 112 for registering the quantity of each liquor dispensed by the automatic mixed drink dispensing apparatus 20. A lamp 114 is provided for illuminating the liquor receiving zone 92. A key-actuated switch 116 is provided for totally disabling the operation of the automatic mixed drink dispensing apparatus 20 whenever this is considered desirable by the owner thereof. A timer switch 118 is also provided for automatically preventing operation of the automatic mixed drink dispensing apparatus 20 during hours of the day in which the dispensing of mixed drinks is prohibited in various jurisdictions. It will be noted that both the key-actuated switch 116 and the timer 118 are contained within the secured liquor receiving zone 92 to prevent access thereto.

The automatic mixed drink dispensing apparatus 20 functions in response to input commands received by means of a push-button comprising the push-button control panel 44. In response to any such input command, the automatic mixed drink dispensing apparatus 20 functions to withdraw the liquids necessary in the preparation of the mixed drink from the various containers thereof and to discharge the liquids through the dispensing head 40. Those skilled in the art will appreciate the fact that the preparation of a particular mixed drink may require the use of one or more syrups and/or the use of water and/or the use of carbonated water and/or the use of one or more liquors. Regardless of either the nature or the number of liquids required to prepare the desired mixed drink, the automatic mixed drink dispensing apparatus 20 functions automatically in response to the receipt of an input command from the push-button control panel 44 to dispense exactly the proper quantity of each liquid through the dispensing head 40, thereby assuring the preparation of a perfect mixed drink.

Figure 3:
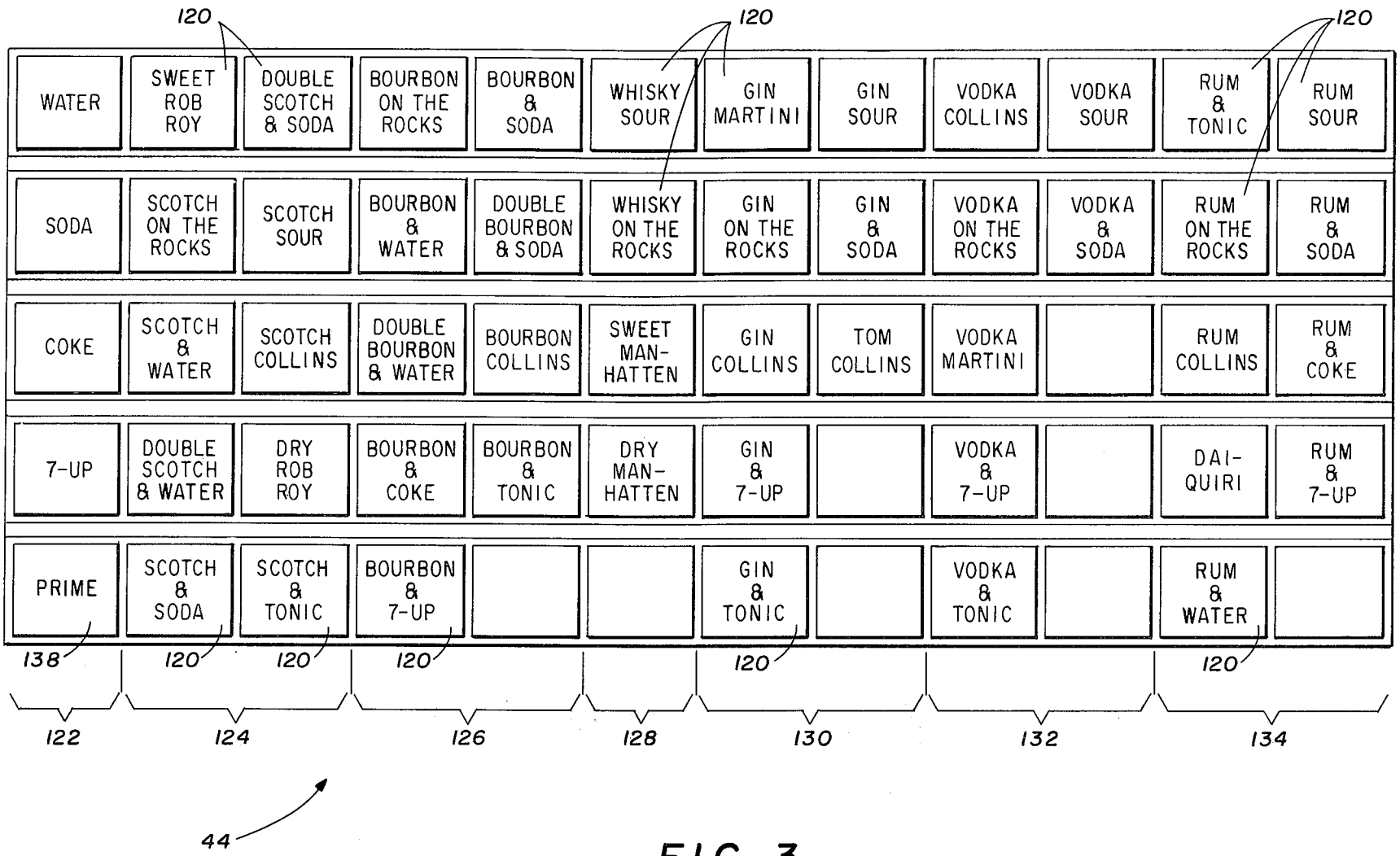
FIG. 3 is an illustration of the push-button control panel of the automatic mixed drink dispensing apparatus.

The push-button control panel 44 of the automatic mixed drink dispensing apparatus 20 is illustrated in greater detail in FIG. 3. The panel 44 comprises a plurality of back-lighted push-buttons 120, most of which have the name of a particular mixed drink indicated thereon. The push-buttons 120 comprising the panel 44 are arranged in sets in accordance with the various liquors which are utilized in making the mixed drinks that are prepared by the automatic mixed drink dispensing apparatus 20. For example, the push-buttons 120 of the set 122 correspond to non-alcoholic drinks. The push-buttons 120 of the set 124 relate to Scotch-based mixed drinks. The push-buttons 120 of the set 126 relate to Bourbon-based mixed drinks. The push-buttons 120 of the set 128 relate to Whiskey-based mixed drinks. The push-buttons 122 of the set 130 relate to Gin-based mixed drinks, and the push-buttons 122 of the set 132 relate to Vodka-based mixed drinks. Finally, the push-buttons 122 of the set 134 relate to Rum-based mixed drinks. It will of course be understood that various liquors other than those indicated may be utilized in the practice of the invention, and that the automatic mixed drink dispensing apparatus 20 may be programmed to dispense mixed drinks other than those indicated in FIG. 3.

Those skilled in the art will appreciate the fact that certain of the numerous mixed drinks indicated on the push-button control panel 44 form the basis for additional mixed drinks. For example, a Rickey mixed drink may be formed from the Scotch and Soda mixed drink, the Bourbon and Soda mixed drink, the Gin and Soda mixed drink, the Vodka and Soda mixed drink, or the rum and Soda mixed drink by adding one quarter of a fresh lime. A Fizz mixed drink may be formed by adding lemon juice and powdered sugar either to the Gin and Soda mixed drink or to the Vodka and Soda mixed drink. A Sling mixed drink may be formed by adding a twist of lemon, lime or orange and an icing of fruit brandy to the Scotch Sour mixed drink, the Gin Sour mixed drink, the Vodka Sour mixed drink, or the Rum Sour mixed drink. One quarter of a fresh lime added to the Rum and Coke mixed drink forms a Cuba Libra. Substituting a cocktail onion for the typical olive in the Gin Martini mixed drink provides a Gibson mixed drink. Various other more complicated mixed drinks are easily formed using the basic mixed drink format of the push-button control panel 44.

The push-button control panel 44 further comprises a "PRIME" push-button 138. Upon actuation, the PRIME push-button 138 disables the dispensing of Scotch upon actuation of any of the push-buttons 120 comprising the set 124. This permits priming of the pumping system for the various mixes utilized in the operation of the automatic mixed drink dispensing apparatus 20 without wasting any liquor.

Figure 6:
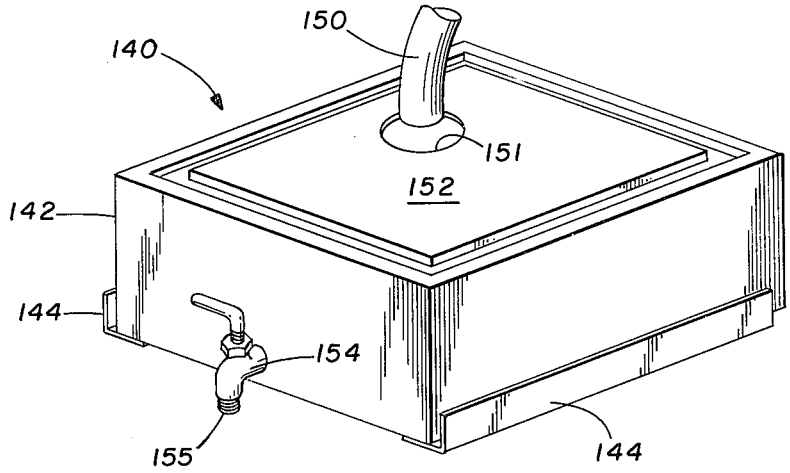
FIG. 6 is a perspective view illustrating a portion of the drain system of the automatic mixed drink dispensing apparatus.

The various systems which make up the automatic mixed drink dispensing apparatus 20 are illustrated in FIGS. 5–19b. Referring first to FIGS. 5 and 6, the automatic mixed drink dispensing system 20 includes a drain system 140. The drain system 140 includes a drain container 142 which is slidably supported on the guides 144 which are in turn mounted on the bottom wall 32 of the housing 22. A conduit 146 extends from a drain in the bottom of the conbined ice chest and cold plate 46, and a conduit 148 extends from the bottom of the drain 42 in the mixed drink preparation zone 36. The conduits 148 and 146 merge into a conduit 150 extending to a point above an opening 151 formed in a panel 152 defining the top of the drain container 142.

The top 152 of the drain container 142 is removable to facilitate cleaning of the drain system 140. A spigot 154 extends to the bottom of the drain container 142 for use in draining fluids therefrom and has a threaded end 155 for the attachment of a hose. Drainage is accomplished by manipulating the housing 22 on the casters 24 until the automatic mixed drink dispensing apparatus 20 is positioned over a drain. The drain container 142 is then pulled outwardly on the guides 144 and the spigot 154 is opened to permit fluid flow therefrom into the drain. Following drainage, the spigot 154 is closed and the drain container 142 is returned to its normal position within the housing 22, after which the drain system 140 is again ready to receive fluids from the combination ice chest and cold plate 46 and from the drain 42.

Figure 8:
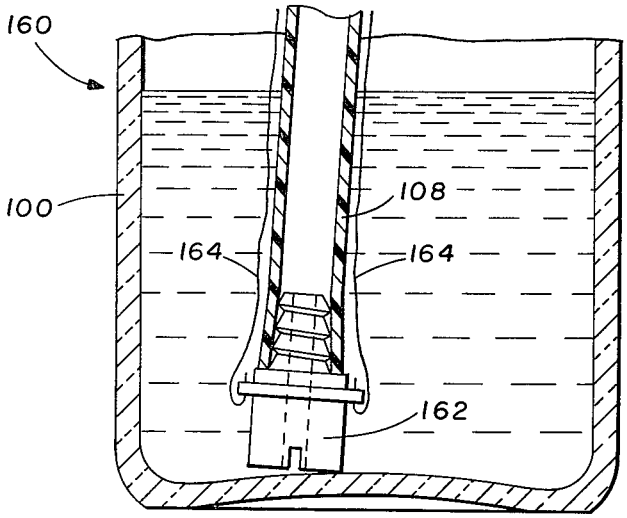
FIG. 8 is an illustration of the empty liquor container warning system of the automatic mixed drink dispensing apparatus.
Figure 9:
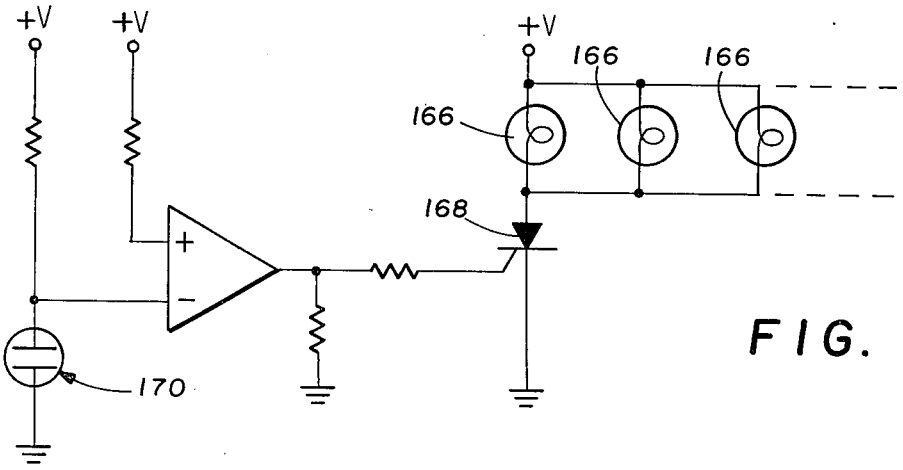
FIG. 9 is a schematic illustration of electronic circuitry associated with the system of FIG. 8.

Referring now to FIGS. 8 and 9, there is shown a system 160 for indicating the fact that the quantity of liquor in one of the liquor containers 100 in the liquor receiving zone 92 has fallen below a predetermined level. Each conduit 108 extends to an inlet fitting 162. A pair of electrical leads 164 extend along the conduit 108 and terminate at the fitting 162. It will thus be understood that the electrical resistance between the terminal ends of the leads 164 changes to a marked degree when the level of liquor in the container 100 falls below the top of the fitting 162.

Referring now to FIGS. 3 and 9, each column of push-buttons 120 comprising the push-button control panel 44 is normally back-lighted by a series of lamps 166, each lamp 166 being individual to one of the push-buttons 120. The lamps 166 are connected between a voltage source and ground through an SCR 168. The distal ends of the electrical leads 164 are illustrated in FIG. 9 at 170. So long as the electrical resistance across this gap remains below a predetermined level, the SCR 168 remains conductive and the lamps 166 remain illuminated. This indicates the presence of at least a predetermined quantity of liquor in the container 100 corresponding to the particular column of push-buttons 120 on the panel 44. However, when the level of liquor in the container 100 falls below the top of the fitting 162, the resistance across the gap 170 comprising the distal ends of the electrical leads 164 is sharply increased. At this point the SCR 168 is rendered non-conductive and the illumination of the lamps 166 is immediately terminated. By this means the operation of the automatic mixed drink dispensing apparatus 20 is notified that a particular quantity of liquor needs to be replaced.

Referring simultaneously to FIGS. 7 and 9, in accordance with a modification of the invention the three-way valves 110 which selectively connect the liquor containers 100 to the liquor pumps 106 may comprise solenoid-actuated three-way valves. In such instances, the circuit of FIG. 9 is modified to operate the associated solenoid-actuated three-way valves to connect the second liquor container 100 of the set to the associated liquor pump 106. The circuit of FIG. 9 may also be utilized to generate an appropriate output signal indicating that the first liquor container of the set has been emptied.

Figure 10:
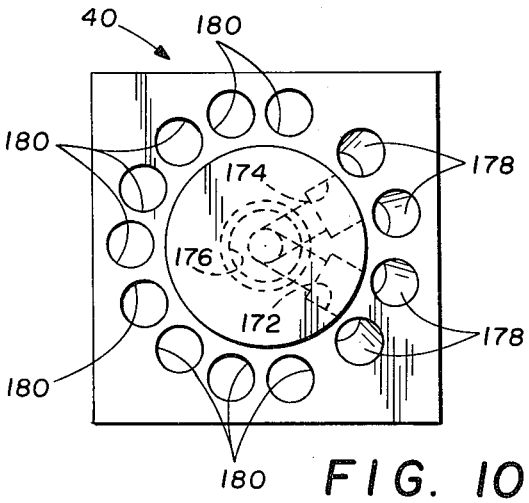
FIG. 10 is a top view of the dispensing head of the automatic mixed drink dispensing apparatus.
Figure 11:
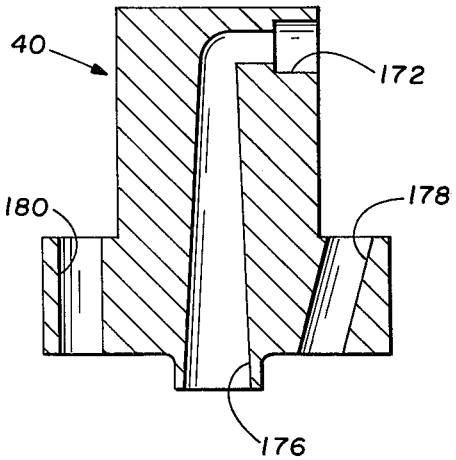
FIG. 11 is a sectional view of the dispensing head.

The dispensing head 40 of the automatic mixed drink dispensing apparatus 20 is illustrated in FIGS. 10 and 11. The dispensing head 40 includes a pair of passageways 172 and 174 which receive water and carbonated water or soda, respectively. Passageways 172 and 174 merge into a downwardly extending passageway 176 which flares outwardly. Four passageways 178 receive various syrups. The passageways 178 extend angularly inwardly so as to thoroughly mix the syrups flowing therethrough with the water or carbonated water flowing through the passageway 176. A total of nine passageways 180 are provided for receiving various liquors. As opposed to the passageways 178, the passageways 180 extend substantially downwardly. It will be understood that in actual practice, the passageways 178 may be used to receive liquors, and the passageways 180 may be used to receive syrups, if desired.

Figure 12:
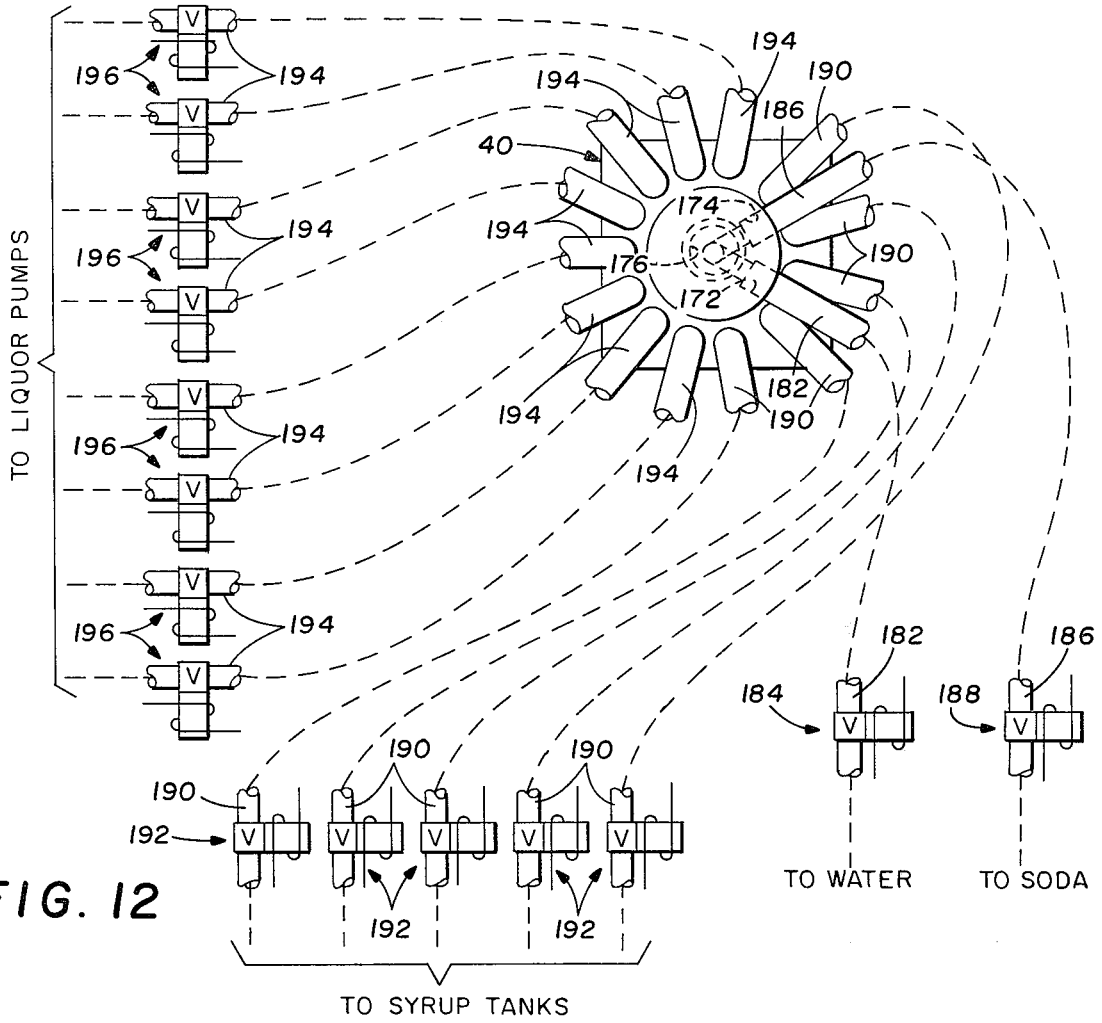
FIG. 12 is an illustration of the system employed in the automatic mixed drink dispensing apparatus for controlling liquid flow through the dispensing head.

Referring now to FIG. 12, water is received in the dispensing head 40 through a conduit 182 extending to the passageway 172. A solenoid-actuated valve 184 is provided in the conduit 182 for precisely regulating the quantity of water that is dispensed through the dispensing head 40. Carbonated water is received in the dispensing head 40 through a conduit 186 extending to the passageway 174. A solenoid-actuated valve 188 is provided in the conduit 186 for precisely regulating the quantity of carbonated water that is discharged through the dispensing head 40. Syrups are received in the dispensing head 40 through a series of conduits 190 each extending either to one of the passageways 178 or to one of the passageways 180. Each conduit 190 is provided with a solenoid-actuated valve 192, and the valves 192 function to precisely regulate the quantity of each syrup which is discharged through the dispensing head 40. Liquors are received in the dispensing head 40 through a plurality of conduits 194 each extending either to one of the passageways 178 or to one of the passageways 180. Each conduit 194 is provided with a solenoid-actuated valve 196. The valves 196 function to precisely control the quantity of each liquor that is discharged through the dispensing head 40.

Figure 13:
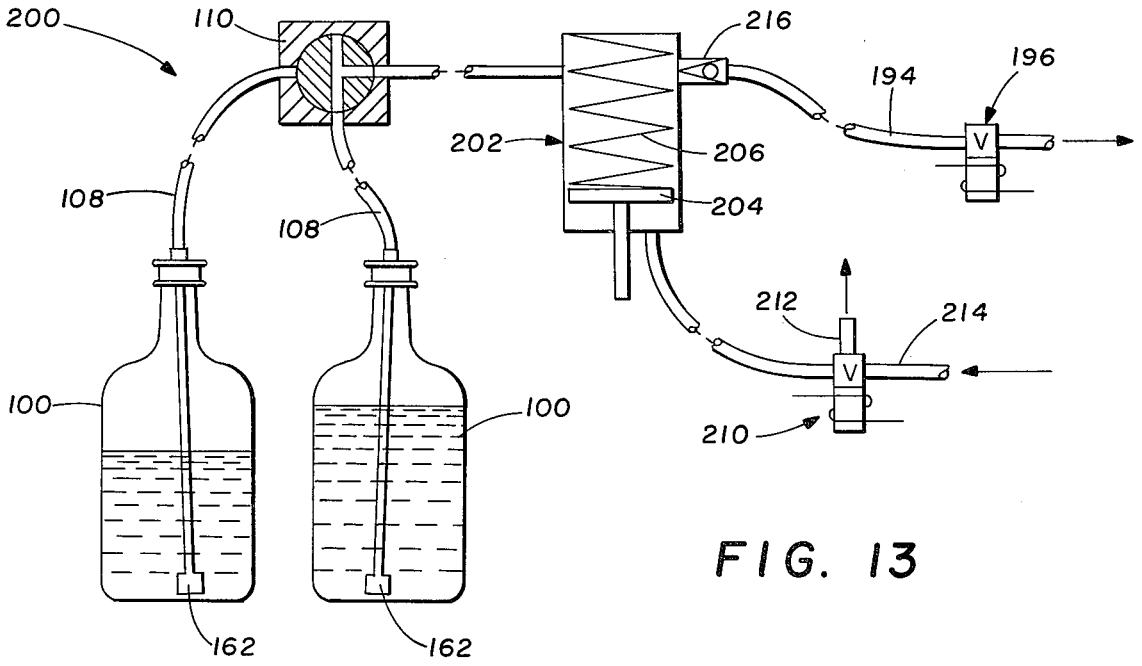
FIG. 13 is an illustration of the liquor pumping system of the automatic mixed drink dispensing apparatus.

In FIG. 13 there is shown a system 200 for pumping liquor from the containers 100 through the dispensing head 40 under the control of one of the solenoid-actuated valves 196. A cylinder 202 has a piston 204 slidably received therein. The piston 204 is normally positioned as shown under the action of a spring 206. Liquor is received in the cylinder 202 from one of the containers 100 through one of the conduits 108 and possibly one of the three-way valves 110. The fitting 162 in each liquor container 100 comprises a check-valve which prevents backflow of liquor from the cylinder 202.

A solenoid-actuated valve 210 normally maintains the rod end of the cylinder 202 at atmospheric pressure through an exhaust port 212. Whenever it is desired to pump liquor, the valve 210 is actuated to close the exhaust port 212 and to simultaneously admit pressurized carbon dioxide gas from the container 88 into the rod end of the cylinder 202 through a passageway 214. The action of the pressurized carbon dioxide gas drives the piston 204 upward in the cylinder 202, thereby pumping liquor through the conduit 194, through the solenoid-actuated valve 196, and through the dispensing head 40. The precise quantity of liquor that is discharged through the dispensing head 40 is regulated by the solenoid-actuated valve 196.

Following the pumping operation, the solenoid-actuated valve 210 is actuated to close the passageway 214 and to return the rod end of the cylinder 202 to its atmospheric pressure through the exhaust port 212. The spring 206 then returns the piston 204 to the position shown. This action draws liquor from the container 100 into the interior of the cylinder 202. A check valve 216 prevents backflow of liquor from the conduit 194.

Figure 14:
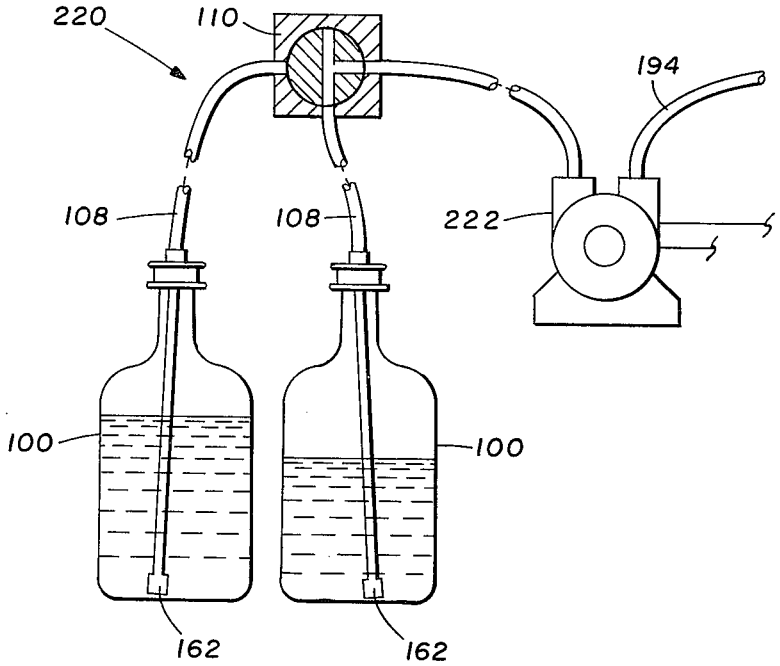
FIG. 14 is an illustration of an alternative liquor pumping system which may be utilized in the mixed drink dispensing apparatus.

An alternative liquor pumping system 220 which may be used in the automatic mixed drink dispensing apparatus 20 instead of the system 200 of FIG. 13 is illustrated in FIG. 14. Rather than the gas-operated pump of the system 200, the system 220 includes a motor-driven pump 222. The system 220 further differs from the system 200 in that rather than regulating the quantity of liquid dispensed by means of a solenoid-actuated valve, the system 220 regulates the quantity of liquor dispensed by controlling the time period of operation of the motor-driven pump 222.

Figure 15:
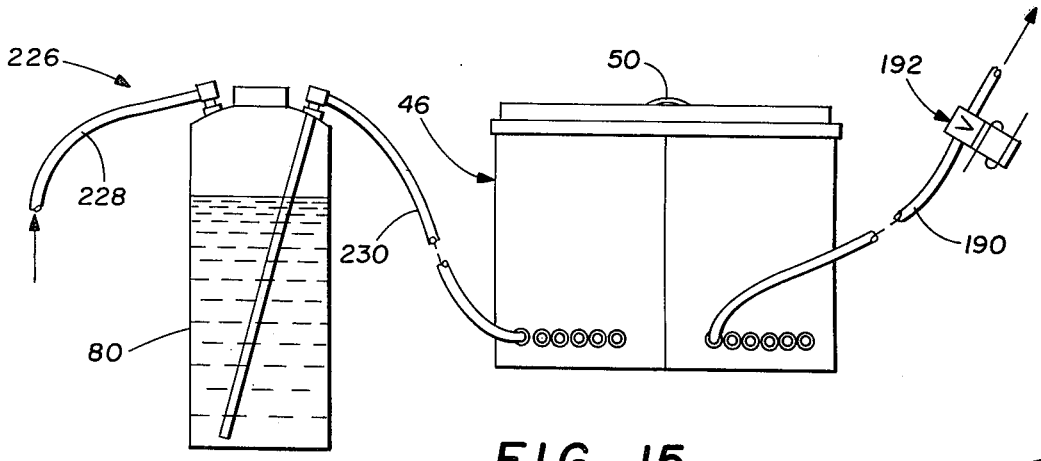
FIG. 15 is an illustration of the syrup pumping system of the automatic mixed drink dispensing apparatus.

A syrup pumping system 226 of the type employed in the automatic mixed drink dispensing apparatus 20 is illustrated in FIG. 15. Pressurized carbon dioxide gas is received at each syrup container 80 from the container 88 through a passageway 228. A passageway 230 extends from the interior of the syrup container 80 to one inlet of the cold plate portion of the combined ice chest and cold plate apparatus 46. One of the conduits 190 extends from the corresponding outlet of the cold plate portion of the combined ice chest and cold plate apparatus 46 to the dispensing head 40 through one of the solenoid-actuated valves 192. Thus, chilled syrup is discharged from the container 80 through the dispensing head 40 under the control of the solenoid-actuated valve 192.

Figure 16:
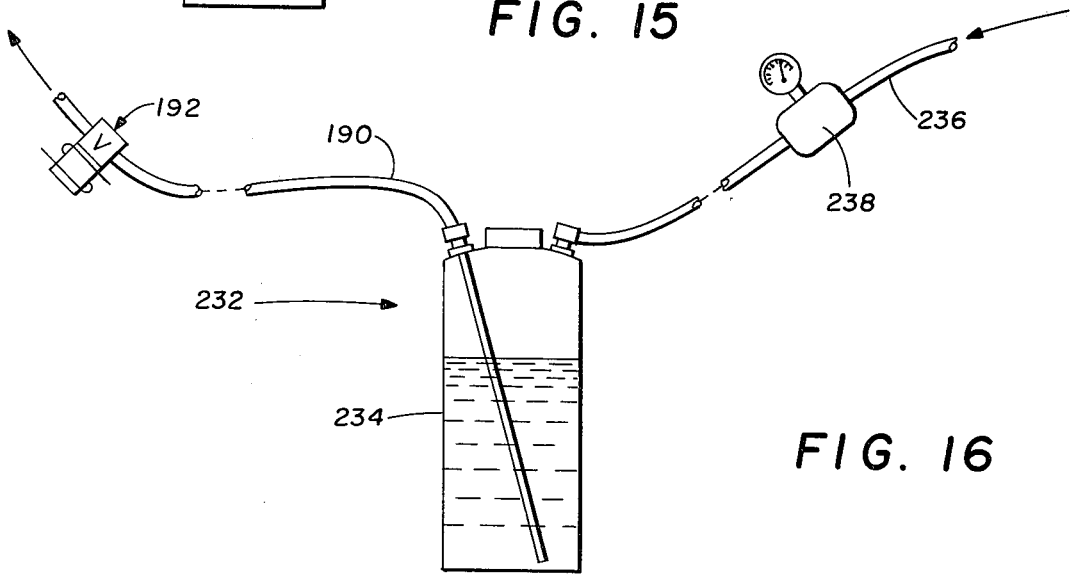
FIG. 16 is an illustration of the sweet and sour mix pumping system of the automatic mixed drink dispensing apparatus.

A sweet and sour mix pumping system 232 is illustrated in FIG. 16. Sweet and sour mix differs from the syrups that are dispensed by the syrup pumping system 226 in that the sweet and sour mix is often not dispensed in combination with water or carbonated water, as are the syrups. Pressurized carbon dioxide gas is received from the container 88 through a conduit 236 at a pressure determined by the setting of a pressure regulator 238. One of the conduits 190 extends from the interior of the container 234 to the dispensing head 40 through one of the valves 192. Thus, sweet and sour mix is discharged from the container 234 through the dispensing head 40 under the control of the solenoid-actuated valve 192.

Figure 17:
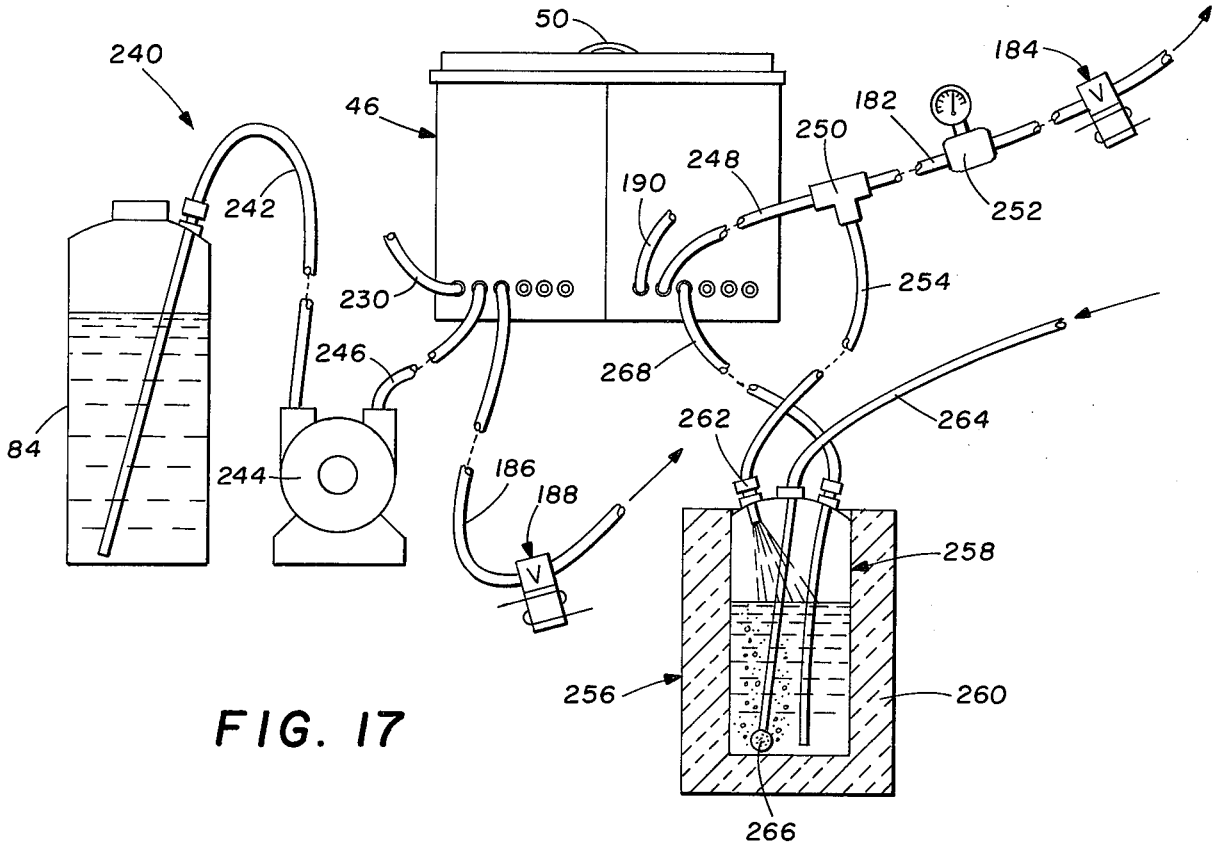
FIG. 17 is an illustration of a combined water pumping system, carbonating apparatus, and carbonated water pumping system employed in the automatic mixed drink dispensing apparatus.

A combined water pumping, carbonating, and carbonated water pumping system 240 is illustrated in FIG. 17. A conduit 242 extends to the interior of the water container 84. The conduit 242 extends to a motor-driven pump 244 which operates to supply pressurized water when needed. The outlet of the pump 244 is connected through a conduit 246 to one inlet of the cold plate portion of the combined ice chest and cold plate apparatus 46. A conduit 248 connects the corresponding outlet of the apparatus 46 to a T-fitting 250.

One outlet of the T-fitting 250 is connected to the conduit 182. The conduit 182 extends through a pressure regulator 252 and the solenoid-actuated valve 184 to the passageway 172 of the dispensing head 40, and to the passageway 176 thereof. By this means the system 240 functions to withdraw water from the container 84 and to discharge chilled water through the dispensing head 40 under the control of the solenoid-actuated valve 184.

The second outlet of the T-fitting 250 is connected through a conduit 254 to a carbonated water making apparatus 256. The apparatus 256 includes a container 258 which is surrounded by a layer of insulating material 260. The conduit 254 extends to a fitting 262 which functions to spray water into the interior of the container 258.

Carbon dioxide gas is received in the container 258 from the container 88 thereof through a conduit 264 and is discharged through an airstone-type outlet 266 in a bubbling manner. The combined effect of spraying water through the carbon dioxide rich atmosphere in the upper portion of the container 258 and the bubbling of carbon dioxide gas through the accumulated liquid in the bottom of the container 258 is to form carbonated water or soda. A conduit 268 extends from the interior of the container 258 to an inlet of the cold plate portion of the combined ice chest and cold plate apparatus 46. The conduit 186 connects the corresponding outlet of the apparatus 46 to the passageway 174 of the dispensing head 40 and hence to the passageway 176 thereof through the solenoid-actuated valve 188. By this means carbonated water is dispensed from the carbonated water making apparatus 256 through the dispensing head 40 under the control of the solenoid-actuated valve 188.

Those skilled in the art will realize the fact that the system 240 is a "low pressure" system which is preferably operated at a reduced temperature to supply carbonated water. "High pressure" systems capable of supplying carbonated water at higher temperatures may also be utilized in the practice of the invention.

Figure 18:
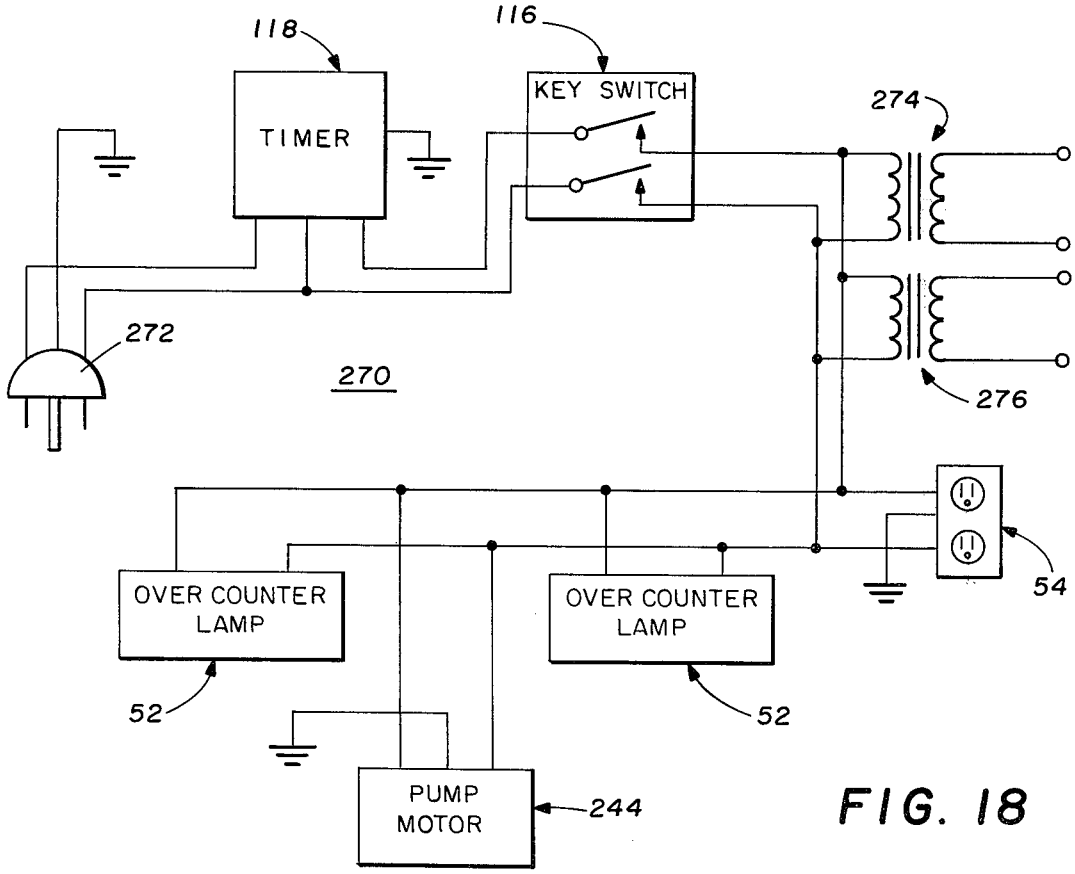
FIG. 18 is a schematic illustration of the power supply circuit for the automatic mixed drink dispensing apparatus.

A power supply circuit 270 for the automatic mixed drink dispensing apparatus 20 is schematically illustrated in FIG. 18. Conventional 115 volt, 60 hz line current is received through a conventional inlet 272. The operation of the automatic mixed drink dispensing apparatus 20 is regulated by the timer 118 and the key-actuated switch 116, both of which are contained within the secured liquor receiving zone 92 of the housing 22. Assuming that both the timer 118 and the key-actuated switch 116 are enabled to permit operation of the automatic mixed drink dispensing apparatus 20, operating power is provided to a pair of transformers 274 and 276 which in turn supply operating power for the circuits illustrated in FIGS. 9, 19 and 20. Operating power is also supplied to the convenience outlet 54, to the light fixtures 52, and to the motor of the motor-driven pump 244 of the system 240.

Figure 19:
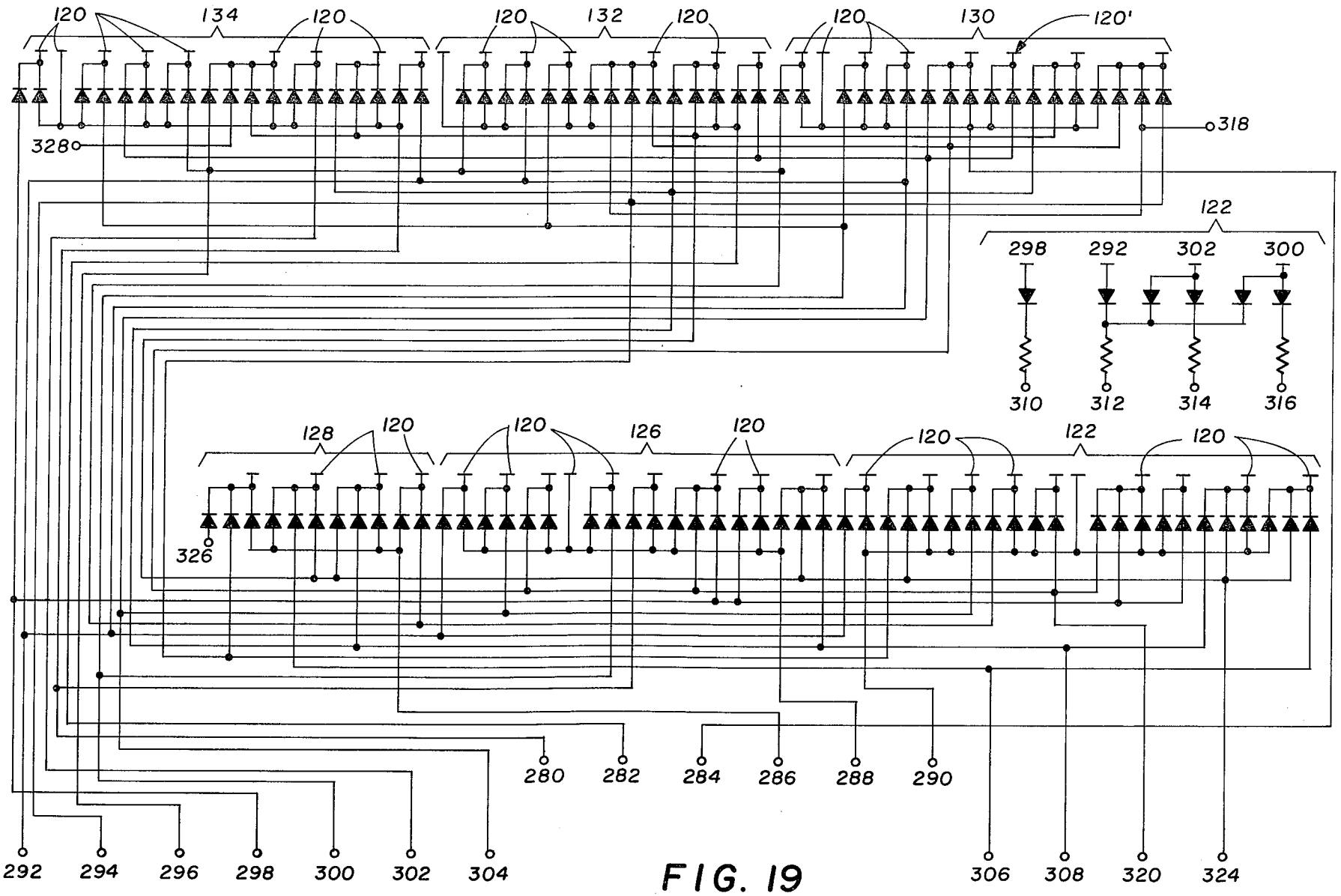
FIG. 19 is a schematic illustration of a diode matrix selector system employed in the mixed drink dispensing apparatus.
Figure 20:
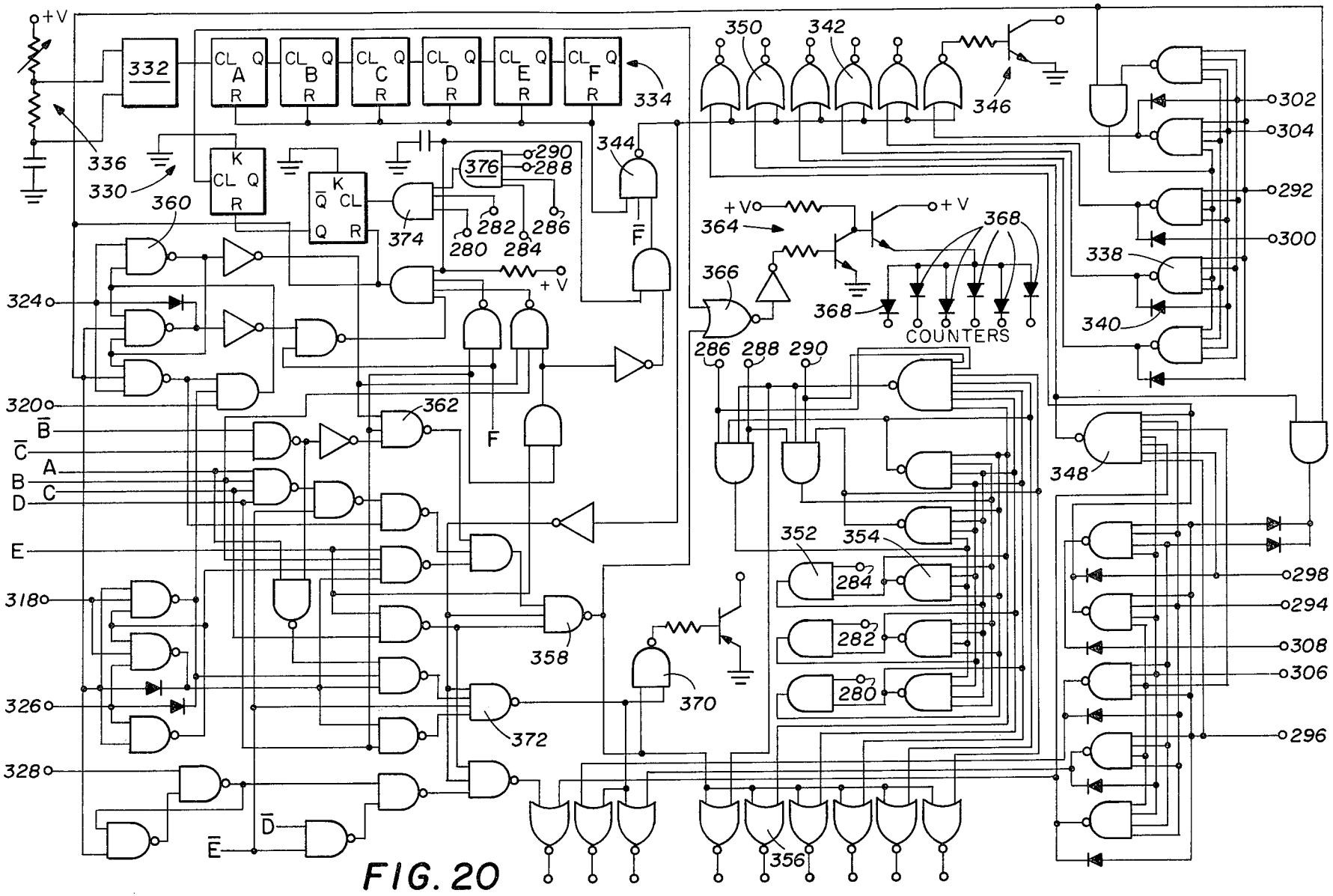
FIG. 20 is a schematic illustration of electronic circuitry employed in controlling the operation of the automatic mixed drink dispensing apparatus.

The operation of the automatic mixed drink dispensing apparatus 20 will be better understood by reference to FIGS. 19 and 20 wherein the electronic circuitry of the system is schematically illustrated. Referring first to FIG. 19, all of the push-buttons 120 comprising the push-button control panel 44 are schematically illustrated. The push-buttons 120 are arranged in groups comprising the sets 122 through 134 inclusive as illustrated in FIG. 3.

The circuit of FIG. 19 comprises a diode matrix. In response to the depression of a particular push-button 120 of the push-button control panel 44, the diode matrix of FIG. 19 functions to select all of the various liquids which are necessary in preparing the mixed drink corresponding to the depressed push-button. Moreover, the diode matrix functions to generate signals indicative of the exact quantity of each of the selected liquids which will be discharged through the dispensing head 40. In this manner, the diode matrix of FIG. 19 functions to translate a single input command comprising the depression of one of the push-buttons 120 into a plurality of output commands indicative of the identity of the various liquids which will be discharged through the dispensing head 40 in preparing the selected mixed drink and further indicative of the precise quantity of each of the selected liquids that will be dispensed.

The diode matrix of FIG. 19 has a multiplicity of output lines, each extending to an output terminal. Thus, the diode matrix has output lines extending to a series of terminals 280, 282, 284, 286, 288, and 290 each corresponding to one of the liquors which may be utilized in preparing mixed drinks under the action of the automatic mixed drink dispensing apparatus 20. A second series of output terminals 292, 294, 296, 298, 300, 302, 304, 306, and 308 each correspond to various liquids which may be mixed with one or more of the liquors in preparing a mixed drink. Those skilled in the art will understand that one of the terminals in the last mentioned series corresponds to the situation in which no liquid is mixed with a selected liquor in order to prepare a drink "on the rocks". Still another series of output terminals 310, 312, 314, and 316 relate to the various liquids which may be dispensed upon actuation of one of the push-buttons 120 comprising the group 122 of FIG. 3. Finally, a series of output terminals 318, 320, 324, 326, and 328 each relate to quantities of liquids which are dispensed under the action of the automatic mixed drink preparation apparatus 20.

Referring now to FIG. 20, an electronic circuit responsive to input command signals received from the diode matrix of FIG. 19 to actuate the various solenoid-actuated valves shown in FIG. 12 to control the flow of liquids through the dispensing head 40 is schematically illustrated. The electronic circuit of FIG. 20 has a plurality of input terminals each corresponding to one of the output terminals of the diode matrix of FIG. 19. Such corresponding input and output terminals of the two Figures are indicated with identical reference numerals to designate direct electrical connections therebetween.

The electronic circuit of FIG. 20 includes a time base generator 330 including an integrated circuit oscillator 332 and a six-bit binary counter 334. Actually, the six-bit binary counter 334 comprises a series of six integrated circuit flip-flops the first being driven by the integrated circuit oscillator 332 and the remaining each being driven by the preceding flip-flop. By this means the six-bit binary counter 334 provides a series of outputs each corresponding to a predetermined period of time. These outputs are designated in the electronic circuit of FIG. 20 by the letters A through F, inclusive. The time period represented by each of these outputs is selectively adjustable by means of a variable resistor 336 connected to the input of the integrated circuit oscillator 332.

The electronic circuit of FIG. 20 further comprises a plurality of input terminals each designated with one of the letters A through F, inclusive. The designation of a particular input terminal with such a letter indicates a direct electrical connection between such terminal and the corresponding designated stage of the binary counter 334. As will be appreciated by those skilled in the art, the positioning of a bar over the letter designating a particular input terminal indicates a direct electrical connection between such terminals and the inverted output of the corresponding designated stage of the binary counter 334.

The electronic circuit of FIG. 20 functions in response to input command signals received from the diode matrix of FIG. 19 to operate one or more of the solenoid-actuated valves of FIG. 12 and thereby cause liquid flow through the dispensing head 40. For example, assume that the push-button 120 of the set 132 bearing the legend "Gin Collins" is depressed. This corresponds to actuation of the push-button 120' as indicated in FIG. 19. Actuation of the push-button 120' in turn causes the diode matrix of FIG. 19 to generate output signals on the terminals 284 and 304.

Returning to the electronic circuit of FIG. 20, output signals on the terminals 284 and 304 of the diode matrix comprise input signals on the corresponding terminals of the electronic circuit. By way of background, it should be understood that at the end of each cycle, the electronic circuit of FIG. 20 automatically resets itself to various preferred states. These include the dispensing of soda or carbonated water in preference to the dispensing of other possible mixes, the dispensing of one ounce of the various liquors in preference to the dispensing of various other amounts, the resetting of the amounts to be dispensed of various mixes in addition to soda, and the negating of the dispensing of any of the various syrups from the syrup containers. Thus, due to such presetting, it is unnecessary to receive input signals if the state of the electronic circuit as of such resetting is satisfactory for the particular drink that is to be dispensed.

The receipt of an input signal on the input terminal 304 of the electronic circuit of FIG. 20 causes a NAND-GATE 338 to generate an output signal which is locked in through a diode 340 and a series of interconnections between the inputs and outputs of the NAND-GATES corresponding to each of the syrups. The output from the NAND-GATE 338 is directed to a NOR-GATE 342 which also receives a signal from a NAND-GATE 344 that determines the time period during which the solenoid-actuated valve corresponding to the dispensing of Collins mix will be opened. Actuation of the NOR-GATE 342 in turn actuates a sub-circuit such as that shown at 346 which is connected directly to the coil of the corresponding soledoid-actuated valve. Thus, the output signal from the NOR-GATE 342 results directly in opening of the solenoid-actuated valve 192 of FIG. 12 which in turn controls the flow of Collins syrup from the container thereof through the conduit 190 and effects the discharge of the Collins syrup through the dispensing head 40.

The resetting feature of the electronic circuit of FIG. 20 automatically causes a NAND-GATE 348 to generate an output signal. This output signal is combined with the output signal from the NAND-GATE 344 in a NOR-GATE 350 to actuate the solenoid-actuated valve 188 and thereby permit the flow of carbonated water or soda through the conduit 186 and hence through the dispensing head 40. The flow of carbonated water or soda through the dispensing head 40 is simultaneous with the flow of Collins syrup therethrough under the control of the NOR-GATE 342.

The input signal received by the input terminal 284 is directed to an AND-GATE 352 which in turn causes a NAND-GATE 354 to generate an output signal. The output signal from the NAND-GATE 354 is directed to a NOR-GATE 356 which also receives an input signal from a NAND-GATE 358. The gate 358 functions to control the time period during which alcohols are dispensed through the dispensing head 40. In the case of the present example, it is desired to dispense one ounce of the required liquor. As has been indicated previously, the resetting feature of the electronic circuit returns the circuit to a one ounce dispensing state at the end of each cycle. This causes a signal to be present on the output of a NAND-GATE 360. The output of the gate 360 is directed to a gate 362 corresponding to the dispensing of one ounce. The gate 362 also receives inputs corresponding to the inverted outputs of the B and C stages of the binary counter 344 and an input corresponding to the output of the D stage of the binary counter 334. These signals are combined by the gate 362 to terminate the output of the gate 358 upon the dispensing of one ounce of the desired liquor.

The gate 356 is actuated by the outputs of the gates 354 and 358 to operate a circuit such as the sub-circuit 346 described hereinbefore in connection with the dispensing of the Collins syrup. The sub-circuit in turn functions to directly control the operation of one of the solenoid-operated valves 196 of FIG. 12. This in turn controls the flow of the selected liquor through the corresponding conduit 194 and through the dispensing head 40. It will be understood that the dispensing of the liquor required for the selected mixed drink occurs simultaneously with the dispensing of the required syrup and the dispensing of the soda under the action of the gates 342 and 350 and the solenoid-actuated valve actuated thereby.

The electronic circuit of FIG. 20 further includes a sub-circuit 364 which operates the counters 112 contained in the secured liquor receiving zone 92 of the housing 22. The sub-circuit 364 includes a NOR-GATE 366 which is connected to the output of the gate 358 and also to the output of the oscillator 332. Thus, whenever the gate 358 is actuated to permit the dispensing of a liquor, the gate 366 produces an output signal. The output from the gate 366 is directed through a series of diodes 368 each extending to one of the counters 112. Each of the counters 112 is interconnected with the solenoid coil of one of the solenoid-actuated valves 196 of FIG. 12. Thus, whenever one of the valves 196 is opened, the corresponding counter is actuated by the oscillator 332 to perform a counting function. By this means the various counters continuously register the quantity of each of the liquors that has been dispensed by the automatic mixed drink dispensing apparatus 20.

The electronic circuit of FIG. 20 further includes a gate 370 which regulates the operation of the solenoid-actuated valve 210 of FIG. 13. The gate 370 has an input connected to the output of the gate 358 and also has an input connected to the output of the gate 372 which corresponds to the dispensing of a particular mix by the automatic mixed drink dispensing apparatus 20. Thus, whenever one of the gates 358 or 372 is actuated to effect dispensing of a liquor or the particular selected mix, the gate 370 functions to actuate the valve 210 to direct carbon dioxide gas inputting through the passageway 214 to the various cylinders 202 of the liquor pump 106 contained within the liquor receiving zone 92 of the housing 22.

The operation of the electronic circuit of FIG. 20 is initiated by a pair of gates 374 and 376 operated in tandem in response to a signal received on any of the terminals 280, 282, 284, 286, 288, or 290. Thus, whenever a signal is received to dispense one of the liquors, a cycle of operation of the electronic circuit of FIG. 20 is automatically initiated. As has been indicated previously, the circuit functions automatically at the end of each cycle to reset itself to a predetermined set of preferred conditions.

Referring again briefly to the diode matrix of FIG. 19, the output terminals 310 through 316 comprising the push-buttons 120 of the set 122 are connected directly to sub-circuits of the type illustrated at 346. By this means it is possible to dispense various non-alcoholic liquids through the dispensing head 40 without initiating a cycle of operation of the electronic circuit of FIG. 20. Moreover, the period of operation of the solenoid-controlled valves corresponding to these liquids is not regulated, and therefore the quantities of liquids dispensed depends solely on the period of time during which the corresponding push-button 120 is held depressed.

Figure 21:
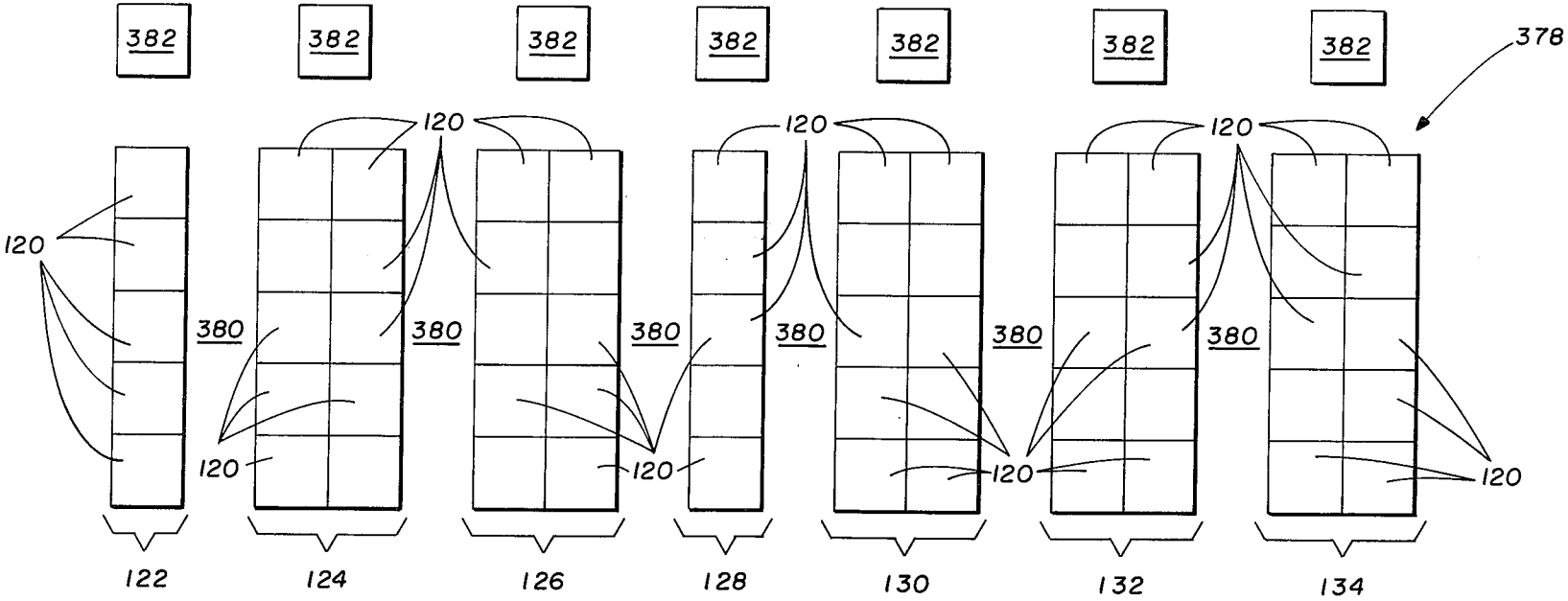
FIG. 21 is an illustration similar to FIG. 3 showing an alternative push-button control panel arrangement.

Referring to FIG. 21, there is shown a push-button control panel 378 which may be utilized in lieu of the push-button control panel 44 of FIG. 3. The push-button control panel 378 comprises an arrangement of push-buttons 120 which is basically similar to the push-button arrangement of FIG. 3, except that the groups 122-134 inclusive are separated by spaces 380. This is to reduce the possibility of accidently depressing an incorrect push-button 120 of the push-button control panel. The push-button control panel 378 further comprises a series of warning lights 382 which are utilized to provide a visual indication of the fact that the quantity of liquid either in the water container 84 or in one of the liquor containers 100 has fallen below a predetermined level.

Figure 22:
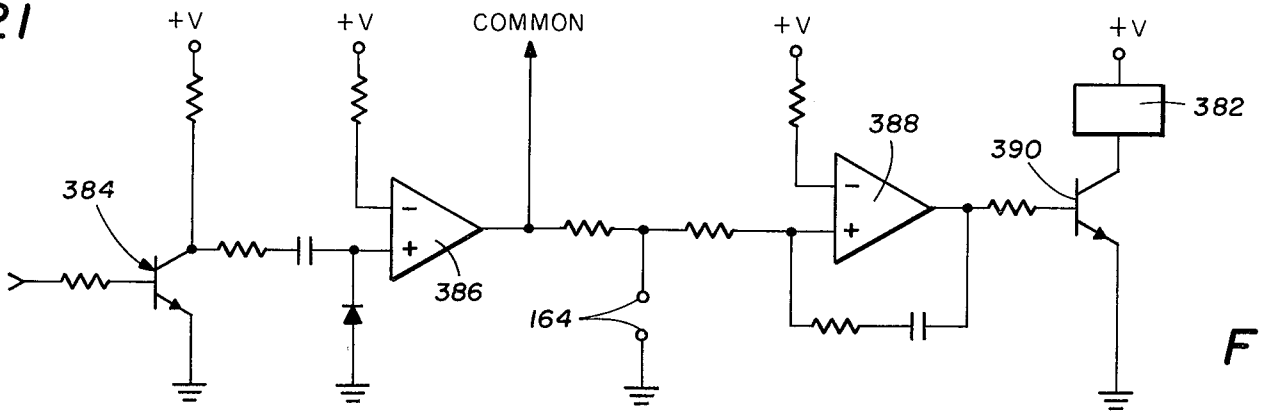
FIG. 22 is an illustration similar to FIG. 9 showing an alternative empty liquor container warning circuitry.

The push-button control panel 378 of FIG. 21 may be utilized in conjunction with the warning circuit of FIG. 22. The circuit of FIG. 22 receives a pulsating input from the stage of the binary counter 334 designated by the letter A. This occurs only when an attempt is made to dispense a drink by means of the system 20. This input is directed through a transistor 384 and an amplifier 386. If an electrical connection is formed across the terminals 164 due to the presence of liquid in a particular container, this input is simply shorted to ground. If no electrical connection is established across the terminals 164, the input is directed to an amplifier 388 and a transistor 390. The corresponding lamp 382 is thereby cyclically operated to provide a visual warning signal indicative of the fact that the quantity of the liquid in the particular container has fallen below a predetermined level.

One advantage to the use of the circuit of FIG. 22 over that of FIG. 9 involves the fact that the circuit of FIG. 22 applies an electrical potential across the terminals 164 only during the dispensing of a drink, and not otherwise. This is advantageous in substantially reducing corrosion of the terminals 164.

From the foregoing, it will be understood that the present invention comprises an automatic mixed drink dispensing apparatus incorporating numerous advantages over the prior art. One of the most important advantages deriving from the use of the invention involves the fact that by means thereof a desired mixed drink is automatically prepared responsive to a push-button input in an absolute minimum of time, thereby eliminating the time consuming aspects of manual mixed drink preparation. Another advantage to the use of the invention involves the fact that liquors are dispensed directly from the original containers thereof, thereby eliminating the problems of spillage and breakage often associated with prior art mixed drink preparation devices wherein it has been necessary to transfer the liquors to specially designed liquor containers. Still another advantage in the use of the invention involves the fact that the liquor containers are housed within a liquor receiving zone which is secured against unauthorized access, thereby eliminating the problem of thievery. A further advantage to the use of the invention involves the fact that in the operation thereof, counters are utilized to continuously monitor the quantity of each liquor dispensed. This provides for complete accountability over the operation of the automatic mixed drink dispensing apparatus.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. An automatic mixed drink dispensing apparatus comprising:

a housing including a bottom wall, front and back walls, opposed side walls, and a top wall defining a mixed drink preparation zone;

said walls of the housing defining therebetween a wholly enclosed liquor receiving zone characterized by means for receiving a plurality of quantities of different liquors each in its original container;

means for securing the housing against access to the interior of the liquor receiving zone from any point around the entire exterior periphery thereof;

said walls of the housing defining a wholly enclosed syrup receiving zone for receiving a plurality of quantities of different syrups each in its original container;

said walls of the housing defining a wholly enclosed water receiving zone;

said walls of the housing defining a wholly enclosed carbon dioxide receiving zone;

ice receiving means mounted in the upper portion of the housing and accessible from the mixed drink preparation zone;

liquid chilling means mounted in the bottom of the ice receiving means;

a liquid dispensing head mounted on the housing and extending into the mixed drink preparation zone at a point over the top wall of the housing;

drain pan means supported in the bottom of the housing and including valve means for selectively permitting fluid flow out of the drain pan means;

drain means for directing liquids from a point in the mixed drink preparation zone under the dispensing head and from a point in the ice receiving means to the drain pan means;

a plurality of liquor pumps each for withdrawing liquor from one of the quantities of liquor in the liquor receiving zone and for discharging the liquor through the dispensing head;

syrup pumping means for withdrawing syrups from the quantities of syrup in the syrup receiving zone and for directing the syrups through the liquid chilling means and through the dispensing head;

water pumping means for withdrawing water from the water receiving zone and for directing water through the liquid chilling means and through the discharge head;

carbonating means for receiving water from the water pumping means, for receiving carbon dioxide gas from the carbon dioxide receiving zone, and for forming carbonated water;

means for directing carbonated water from the carbonating means through the liquid chilling means and through the dispensing head;

said liquors, syrups, water, and carbonated water defining a plurality of liquids available for formulating mixed drinks; and electronic circuitry means for receiving a plurality of input signals each individual to a particular mixed drink and responsive thereto for selecting one or more of the plurality of liquids to be used in formulating a desired mixed drink and for effecting discharge of a predetermined quantity of each selected liquid through the dispensing head.

2. The automatic mixed drink dispensing apparatus according to claim 1 wherein the front, back and side walls of the housing are each further characterized by at least one openable panel to provide access to substantially the entire interior of the housing.

3. The automatic mixed drink dispensing apparatus according to claim 2 wherein the securing means is further characterized by a bulkhead extending through the interior of the housing between the front, back, top, and bottom walls for separating the liquor receiving zone from the remainder of the interior of the housing and for cooperation with portions of the front, back and side walls to define the exterior periphery of the liquor receiving zone, and further including means for selectively preventing opening of the openable panels of the portions of the front, back, and side walls which, together with the bulkhead, define the exterior periphery of the liquor receiving zone.

4. The automatic mixed drink dispensing apparatus according to claim 1 wherein each liquor pump comprises:

cylinder means;

piston means mounted for reciprocation in the cylinder means;

check valve means for admitting liquor from one of the quantities thereof to one end of the cylinder means;

check valve means for directing liquor from the cylinder means to the dispensing head;

means for selectively admitting pressurized carbon dioxide gas from the carbon dioxide receiving zone to the opposite end of the cylinder means and thereby actuating the piston means to force liquor out of the cylinder means and through the dispensing head; and spring means for subsequently returning the piston means and thereby drawing liquor into said one end of the cylinder means.

5. The automatic mixed drink dispensing apparatus according to claim 4 further including valve means associated with each liquor pump and operable under the control of the electronic circuitry means to regulate the quantity of liquor discharged through the dispensing head upon each actuation of the liquor pump.

6. The automatic mixed drink dispensing apparatus according to claim 1 wherein each liquor pump comprises a motor driven pump and wherein the electronic circuitry means functions to control the quantity of liquor dispensed by regulating the duration of the operation of the motor-driven pump.

7. The automatic mixed drink dispensing apparatus according to claim 1 wherein the syrup pumping means comprises:

means for directing pressurized carbon dioxide gas from the carbon dioxide receiving zone into each syrup container;

means for directing syrup from each syrup container through the dispensing head under the action of the carbon dioxide gas; and valve means operable under the control of the electronic circuitry means for regulating the flow of syrup from each syrup container through the dispensing head.

8. The automatic mixed drink dispensing apparatus according to claim 1 wherein the electronic circuitry means further includes counter means for recording the quantity of each liquor that is dispensed from the liquor containers in the liquor receiving zone through the dispensing head.

9. The automatic mixed drink dispensing apparatus according to claim 1 further characterized by:

means for monitoring the quantity of liquor in each liquor container within the liquor receiving zone; and means for generating a predetermined output signal whenever the quantity of liquor within any particular container falls below a predetermined level.

10. An automatic mixed drink dispensing apparatus comprising:

a housing including a bottom wall, front and back walls, opposed side walls, and a top wall defining a mixed drink preparation zone;

said front, back, and side walls each defining at least one openable panel to provide access to substantially the entire interior of the housing;

a bulkhead extending between the front, back, top, and bottom walls for cooperation with portions of the front, back, and side walls to define a wholly enclosed liquor receiving zone characterized by means for receiving a plurality of quantities of different liquors each in its original container;

means for securing the housing against access to the interior of the liquor receiving zone from any point around its entire exterior periphery;

means within the housing for receiving a plurality of syrup containers each having a quantity of syrup therein;

means within the housing for receiving a water container having a quantity of water therein;

means within the housing for receiving a carbon dioxide container having a quantity of carbon dioxide therein;

ice receiving means mounted in the upper portion of the housing and accessible from the mixed drink preparation zone;

liquid chilling means mounted in the bottom of the ice receiving means;

a dispensing head mounted on the housing and extending into the mixed drink preparation zone at a point over the top wall of the housing;

drain pan means slidably supported in the bottom of the housing and including valve means for selectively permitting fluid flow out of the drain pan means;

drain conduit means for directing liquids from a point in the mixed drink preparation zone under the dispensing head and from a point in the ice receiving means to the drain pan means;

a plurality of liquor pumps each for withdrawing liquor from one of the liquor containers in the liquor receiving zone and for discharging the liquor through the dispensing head;

syrup pumping means for withdrawing syrups from the syrup containers and for directing the syrups through the liquid chilling means and through the dispensing head;

valve means for controlling the flow of syrups through the dispensing head under the action of the syrup pumping means;

water pumping means for withdrawing water from the water container and for directing the water through the liquid chilling means and through the dispensing head;

valve means for controlling the flow of water through the dispensing head under the action of the water pumping means;

carbonating means for receiving water from the water pumping means, for receiving carbon dioxide gas from the carbon dioxide container, and for forming carbonated water;

means for directing carbonated water from the carbonating means through the liquid chilling means and through the dispensing head;

valve means for controlling the flow of carbonated water through the dispensing head;

said liquors, syrups, water, and carbonated water defining a plurality of liquids available for formulating mixed drinks;

a plurality of push-buttons each corresponding to a particular mixed drink; and electronic circuitry means responsive to actuation of the push-button for selecting one or more of the plurality of liquids to be used in formulating a desired mixed drink and for effecting discharge of a predetermined quantity of each selected liquid through the dispensing head.

11. The automatic mixed drink dispensing apparatus according to claim 10 wherein the openable panels of the housing include a removable panel normally received in a portion of the front wall, a removable panel normally received in a portion of one of the side walls, and a hingedly supported door on the back wall, said removable panels and door for cooperation with the bulkhead to normally enclose the liquor receiving zone, means operable from within the liquor receiving zone for selectively preventing removal of the removable panels, and a lock mechanism for selective actuation to prevent opening of the door.

12. The automatic mixed drink dispensing apparatus according to claim 10 wherein each liquor pump comprises:

cylinder means;

piston means mounted for reciprocation in the cylinder means;

check valve means for admitting liquor from at least one of the liquor containers into one end of the cylinder means;

check valve means for directing liquor from said one end of the cylinder means through the dispensing head;

means for selectively directing pressurized carbon dioxide gas from the carbon dioxide container into the opposite end of the cylinder means and thereby actuating the piston means to force liquor from one said end of the piston means through the dispensing head; and spring means for subsequently reciprocating the piston means in the opposite direction and thereby drawing liquor into said one end of the cylinder means.

13. The automatic mixed drink dispensing apparatus according to claim 10 further characterized by:

valve means operable under the control of the electronic circuitry means for controlling the flow of liquor from each liquor pump through the dispensing head; and counter means operable in synchronism with the liquor controlling valve means to register the quantity of each liquor dispensed.

14. The automatic mixed drink dispensing apparatus according to claim 10 wherein each liquor pump comprises a motor-driven liquor pump and wherein the electronic circuitry means controls the amount of liquor dispensed by regulating the period of operation of the motor-driven pump.

15. The automatic mixed drink dispensing apparatus according to claim 10 wherein the syrup pumping means comprises:

means for directing pressurized carbon dioxide gas from the carbon dioxide container into each syrup container; and means for directing syrup from each syrup container through the dispensing head under the action of the pressurized carbon dioxide gas.

16. The automatic mixed drink dispensing apparatus according to claim 10 wherein the carbonating means comprises:

container means;

means for receiving water from the water pumping means and for spraying the water through accumulated gas in the container means; and means for receiving carbon dioxide gas from the carbon dioxide container and for bubbling the carbon dioxide gas through liquid accumulated in the container means.

17. The automatic mixed drink dispensing apparatus according to claim 10 further characterized by means for sensing the level of liquor in each liquor container in the liquor receiving zone and for generating a predetermined output signal whenever the level of liquor in any of the containers falls below a predetermined level.

18. The automatic mixed drink dispensing apparatus according to claim 17 wherein the level sensing means includes:

a pair of electrodes extending into each liquor container; and electronic circuitry means responsive to a change in electrical resistance between the pair of electrodes to generate the predetermined output signal.

19. The automatic mixed drink dispensing apparatus according to claim 10 further including timer means mounted within the liquor receiving zone for selectively preventing operation of the mixed drink dispensing apparatus except during predetermined periods of each day.

20. An automatic mixed drink dispensing apparatus comprising:

means defining a mixed drink preparation zone;

means defining a liquor receiving zone for receiving a plurality of quantities of different liquors each in its original container;

means for receiving a plurality of syrup containers each having a quantity of syrup therein;

means for receiving a water container having a quantity of water therein;

means for receiving a carbon dioxide container having a quantity of carbon dioxide therein;

ice receiving means accessible from the mixed drink preparation zone;

liquid chilling means mounted in the bottom of the ice receiving means;

a dispensing head extending into the mixed drink preparation zone;

drain means positioned in the mixed drink preparation zone beneath the dispensing head;

a plurality of liquor pumps each for withdrawing liquor from one of the liquor containers in the liquor receiving zone and for discharging the liquor through the dispensing head;

solenoid-actuated valve means for controlling the flow of liquor through the dispensing head under the action of the liquor pumps;

syrup pumping means for withdrawing syrups from the syrup containers and for directing the syrups through the liquid chilling means and through the dispensing head;

solenoid-actuated valve means for controlling the flow of syrups through the dispensing head under the action of the syrup pumping means;

water pumping means for withdrawing water from the water container and for directing water through the liquid chilling means and through the dispensing head;

solenoid-actuated valve means for controlling the flow of water through the dispensing head under the action of the water pumping means;

carbonating means for receiving water from the water pumping means, for receiving carbon dioxide gas from the carbon dioxide container, and for forming carbonated water;

means for directing the carbonated water from the carbonating means through the liquid chilling means and through the dispensing head;

solenoid-actuated valve means for controlling the flow of carbonated water through the dispensing head;

said liquors, syrups, water and carbonated water defining a plurality of liquids available for formulating mixed drinks;

a plurality of push-buttons each corresponding to a particular mixed drink;

circuit means responsive to the actuation of the push-buttons for generating a plurality of output signals indicative of the particular liquids from the plurality thereof to be utilized in formulating the desired mixed drink and further indicative of the quantity of each liquid to be dispensed; and electronic circuitry means responsive to the output signals from the circuit means for operating the solenoid-actuated valve means corresponding to each of the selected liquids for a predetermined period of time and thereby discharging the proper quantity of each selected liquid through the dispensing head.

21. The automatic mixed drink dispensing apparatus according to claim 20 wherein each liquor pump comprises:

a cylinder;

a piston mounted for reciprocation within the cylinder;

a spring for biasing the piston to reciprocate toward the rod end of the cylinder;

means for selectively admitting pressurized carbon dioxide gas from the carbon dioxide container into the rod end of the cylinder and thereby forcing the piston to the blind end of the cylinder against the action of the spring means;

means for connecting the blind end of the cylinder to one of the liquor containers and to the dispensing head; and check-valve means for preventing backflow of liquor from the dispensing head into the blind end of the cylinder and from the blind end of the cylinder into the container.

22. The automatic mixed drink dispensing apparatus according to claim 21 further characterized by counter means operable in synchronism with each of the solenoid-actuated valves which regulate the discharge of a liquor through the dispensing head to register the quantity of each liquor dispensed.

23. The automatic mixed drink dispensing apparatus according to claim 20 wherein each liquor pump comprises a motor-driven liquor pump.

24. The automatic mixed drink dispensing apparatus according to claim 20 wherein the syrup pumping means comprises means for admitting pressurized carbon dioxide gas from the carbon dioxide container into the syrup container and means extending from each syrup container to the dispensing head for discharging syrup through the dispensing head under the action of the pressurized carbon dioxide gas in the syrup container and under the control of the associated solenoid-actuated valves.

25. The automatic mixed drink dispensing apparatus according to claim 20 wherein the carbonating means comprises:

a container;

means for receiving water from the water pumping means and for spraying the water into the container means through gas accumulated therein;

means for receiving carbon dioxide gas from the carbon dioxide container and for bubbling the carbon dioxide gas through liquid accumulated in the container means; and means for directing carbonated water from the container means to the dispensing head under the control of the solenoid-actuated valve.

26. The automatic mixed drink dispensing apparatus according to claim 20 further characterized by means for sensing the level of liquor in each liquor container in the liquor receiving zone and for generating a predetermined output signal whenever the level of liquor in one of the containers falls below a predetermined level.

27. The automatic mixed drink dispensing apparatus according to claim 26 wherein the liquor level sensing means includes:

conduit means extending into each liquor container for receiving liquor therefrom;

a pair of spaced apart electrodes mounted on each conduit means and extending therewith into each liquor container to a point therein spaced a predetermined distance above the bottom of the liquor container; and electronic circuitry means responsive to a change in electrical resistance between the pair of electrodes to generate an output signal indicative of a liquor level in the container below the lowermost points of the electrodes.

28. The automatic mixed drink dispensing apparatus according to claim 20 further including housing means for receiving the liquor containers, the syrup containers, the water container, and the carbon dioxide container and defining the mixed drink preparation zone.

29. The automatic mixed drink dispensing apparatus according to claim 28 wherein the housing means further comprises means securing the liquor receiving zone against unauthorized access thereto.

30. The automatic mixed drink dispensing apparatus according to claim 29 wherein the housing means further comprises drain pan means and drain conduit means extending from the drain means of the mixed drink preparation zone and from the ice receiving means to the drain pan means.

31. An automatic mixed drink dispensing apparatus comprising:

means defing a mixed drink preparation zone;

means defining a liquor receiving zone for receiving a plurality of quantities of different liquors each in its original container;

means for receiving a plurality of syrup containers each having a quantity of syrup therein;

means defining a source of water;

means defining a source of carbonated water;

a dispensing head extending into the mixed drink preparation zone;

drain means positioned in the mixed drink preparation zone beneath the dispensing head;

a plurality of liquor pumps each for withdrawing liquor from one of the liquor containers in the liquor receiving zone and for discharging the liquor through the dispensing head;

solenoid-actuated valve means for controlling the flow of liquor through the dispensing head under the action of the liquor pumps;

syrup pumping means for withdrawing syrups from the syrup containers and for directing the syrups through the liquid chilling means and through the dispensing head;

solenoid-actuated valve means for controlling the flow of syrups through the dispensing head under the action of the syrup pumping means;

means for directing water from the source through the dispensing head;

solenoid-actuated valve means for controlling the flow of water through the dispensing head;

means for directing the carbonated water from the source through the dispensing head;

solenoid-actuated valve means for controlling the flow of carbonated water through the dispensing head;

said liquors, syrups, water and carbonated water defining a plurality of liquids available for formulating mixed drinks;

a plurality of push-buttons each corresponding to a particular mixed drink;

circuit means responsive to the actuation of the push-buttons for generating a plurality of output signals indicative of the particular liquids from the plurality thereof to be utilized in formulating the desired mixed drink and further indicative of the quantity of each liquid to be dispensed; and electronic circuitry means including means for generating a plurality of outputs each corresponding to a different predetermined period of time and logic means responsive to the output signals from the circuit means for operating the solenoid-actuated valve means corresponding to each of the selected liquids for a predetermined period of time corresponding to a selected one of said outputs and thereby discharging the proper quantity of each selected liquid through the dispensing head.

32. The automatic mixed drink dispensing apparatus according to claim 31 wherein each liquor pump comprises:

a cylinder;

a piston mounted for reciprocation within the cylinder;

a spring for biasing the piston to reciprocate toward the rod end of the cylinder;

means for selectively admitting pressurized gas into the rod end of the cylinder and thereby forcing the piston toward the blind end of the cylinder against the action of the spring means;

means for connecting the blind end of the cylinder to one of the liquor containers and to the dispensing head; and check-valve means for preventing backflow of liquor from the dispensing head into the blind end of the cylinder and from the blind end of the cylinder into the container.

33. The automatic mixed drink dispensing apparatus according to claim 32 further characterized by counter means operable in synchronism with each of the solenoid-actuated valves which regulate the discharge of a liquor through the dispensing head to register the quantity of each liquor dispensed.

34. The automatic mixed drink dispensing apparatus according to claim 31 wherein each liquor pump comprises a motor-driven liquor pump.

35. The automatic mixed drink dispensing apparatus according to claim 31 wherein the syrup pumping means comprises means for admitting pressurized gas into the syrup container and means extending from each syrup container to the dispensing head for discharging syrup through the dispensing head under the action of the pressurized gas in the syrup container and under the control of the associated solenoid-actuated valves.

36. The automatic mixed drink dispensing apparatus according to claim 31 further characterized by means for sensing the level of liquor in each liquor container in the liquor receiving zone and for generating a predetermined output signal whenever the level of liquor in one of the containers falls below a predetermined level.

37. The automatic mixed drink dispensing apparatus according to claim 36 wherein the liquor level sensing means includes:

conduit means extending into each liquor container for receiving liquor therefrom;

a pair of spaced apart electrodes mounted on each conduit means and extending therewith into each liquor container to a point therein spaced a predetermined distance above the bottom of the liquor container; and electronic circuitry means responsive to a change in electrical resistance between the pair of electrodes to generate an output signal indicative of a liquor level in the container below the lowermost points of the electrodes.

38. The automatic mixed drink dispensing apparatus according to claim 31 further including housing means for receiving the liquor containers, the syrup containers, the water container, and the carbon dioxide container and defining the mixed drink preparation zone.

39. The automatic mixed drink dispensing apparatus according to claim 38 wherein the housing means further comprises means securing the liquor receiving zone against unauthorized access thereto.

* * * * *